US006213657B1

(12) United States Patent
Kobayashi

(10) Patent No.: US 6,213,657 B1
(45) **Date of Patent: *Apr. 10, 2001**

(54) AUTOMATIC PROCESSOR FOR SILVER HALIDE LIGHT-SENSITIVE PHOTOGRAPHIC MATERIAL

(75) Inventor: Hiroaki Kobayashi, Tokyo (JP)

(73) Assignee: Konica Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/149,137

(22) Filed: Sep. 8, 1998

(30) Foreign Application Priority Data

Sep. 8, 1997 (JP) ..... 9-243034
Jun. 16, 1998 (JP) ..... 10-168968

(51) Int. Cl.[7] ..... G03D 5/00
(52) U.S. Cl. ..... 396/604; 396/606; 396/626
(58) Field of Search ..... 396/626, 627, 396/604, 606; 134/122 R, 122 P; 355/27–29

(56) References Cited

U.S. PATENT DOCUMENTS 5,506,652 * 4/1996 Gogle et al. ..... 396/626
5,698,382 * 12/1997 Nakahanada et al. ..... 396/604
5,832,328 * 11/1998 Ueda ..... 396/627
5,988,896 * 11/1999 Edgar ..... 396/604

FOREIGN PATENT DOCUMENTS 0 587 097 A1 3/1994 (EP) .
0 620 495 A1 10/1994 (EP) .
0 710 884 A1 5/1996 (EP) .
09090578 4/1997 (JP) .
98/19216 5/1998 (WO) .

* cited by examiner

*Primary Examiner*—D. Rutledge
(74) *Attorney, Agent, or Firm*—Finnegan, Henderson, Farabow, Garrett & Dunner, L.L.P.

(57) ABSTRACT

An automatic processor for a silver halide light sensitive photographic material is disclosed. The automatic processor comprises at least two reservoirs storing partial processing compositions separately, and a supply means to supply each of said partial compositions to said silver halide light-sensitive photographic material after mixing said partial compositions.

17 Claims, 14 Drawing Sheets

AUTOMATIC PROCESSOR FOR SILVER HALIDE LIGHT-SENSITIVE PHOTOGRAPHIC MATERIAL

TECHNICAL FIELD OF THE INVENTION

The present invention relates to an automatic processor for a sliver halide light-sensitive photographic material (hereinafter referred to as automatic processor), and more specifically to an automatic processor for a silver halide light-sensitive photographic material, which enables rapid processing, and can obtain a stable processing characteristics exhibiting improvements in uneven processing and oxidation degradation of the processing compositions.

A Silver halide light-sensitive photographic material is processed as follows. For example, the photographic material is conveyed employing a roller conveyance mechanism and is processed while being immersed for predetermined periods in enough processing composition for silver halide light-sensitive photographic material (hereafter it is called as processing composition in short) filled in processing tanks such as a developing tank, a bleach-fixing tank, etc. During processing photographic materials, working components in the processing composition stored in a tank are consumed and the processing composition is subjected to fatigue degradation. Furthermore, for example, when a developing composition is alkaline, the degradation is caused by the decreases in alkalinity due to neutralization reaction upon absorbing carbonic acid gas and aging fatigue caused by oxidation.

In order to solve the above problems, as described, for example, in Japanese Patent Publication Open to Public Inspection No. 3-59655, it is proposed that in the conveyance path of a silver halide light-sensitive photographic material, a coating roller is disposed; with this coating roller, a processing composition supply roller is provided; between the coating roller and supply roller, the processing composition staying portion is provided, and in accordance with the rotation of the coating roller, the coating composition is supplied and coated onto the image forming surface of a silver halide light-sensitive photographic material.

SUMMARY OF THE INVENTION

In such a case, uneven processing is easily caused and this is remarkable at rapid processing. Especially uneven processing is caused at the end portion of the light sensitive material. Further, compositions of the developing composition or the bleach-fixing composition stored in the tank can vary and the processing stability is degraded. Furthermore, the coating development method causes uneven processing and stain. Recently light sensitive material is processed after cutting and transported in majority of processing way in view of rapid processing and environmental adaptability. In the occasion uneven processing at the end portion is remarkable. And also supplying roller and transporting portion are stained during long time processing depending on ingredients of the composition.

In order to overcome the above problems, for example, Japanese Patent Publication Open to Public Inspection Nos. 9-90579, 9-90580, 9-90581, etc. describe methods in which two kinds of partial color developing compositions (hereafter it may be referred to as two composition development in short) are supplied to a silver halide light-sensitive photographic material (hereinafter referred to as light-sensitive material) during the gas phase. This method improves processing stability. However, two processing composition supply means are independently arranged and after a first partial composition is supplied, a second partial composition is supplied. The following was found. Because the second partial composition is supplied after the first partial composition is supplied, the processing time is extended. Though the processing stability is improved, the mixing ratio of two compositions fluctuates depending on positions causing uneven development and the problem is not fully solved.

Recently it is found that the first composition is flow into the second composition when the second composition is coated in case of two composition processing, and consequently the rapid processing is avoided. The reaction does not start until the second composition is coated, time is lost. A new problem is also found that period during the coatings of the first and second compositions is shortened to improve the time loss, vigorous uneven processing is caused.

In order to solve the foregoing problems, the present invention is accomplished. Objects of the present invention is to provide the following. First, the uneven processing such as uneven development at the end portion of the light sensitive material and uneven processing due to the fluctuation of mixing ratio of two compositions is avoided. Second, rapid processing is improved. Third, the storage stability of a processing composition is improved so that in practice, the composition is subjected to neither deposition nor oxidation degradation. Fourth, uneven processing due to fluctuation of the mixing ratio of two compositions is minimized. Fifth, staining automatic processor members caused by the dripping of a coating composition, etc. can be decreased. Fourth, the dimensions of an automatic processor are decreased.

MEANS FOR DISSOLVING THE TECHNICAL SUBJECT MATTER

The present invention and its embodiment are described.

The automatic processor for a silver halide light-sensitive photographic material of the invention comprising at least a process of coating a processing composition for a development process. The automatic processor comprises at least two reservoirs to store partial processing compositions separately, a supply means to supply each of said partial compositions to said silver halide light-sensitive photographic material after mixing said partial compositions and coating means to coat the mixed partial processing compositions on the surface of the silver halide light-sensitive photographic material.

A heating means is preferably provided with the automatic processor which directly heats said silver halide light-sensitive photographic material.

According to this quicker processing can be achieved by supplying a processing composition upon directly heating a silver halide light-sensitive photographic material.

The silver halide light-sensitive photographic material is heated preferably not lower than 45° C.

According to this quicker processing can be achieved by supplying a processing composition upon directly heating a silver halide light-sensitive photographic material.

The automatic processor preferably comprises control means to control the total processing composition supply amount from said processing composition supply exit to said coating roller being at 10 to 160 ml per $m^2$ of said light-sensitive material.

By setting the total processing composition supply amount at 10 to 160 ml per $m^2$, the appropriate amount of the processing composition can be supplied to the coating and thus, it becomes possible to decrease the dimensions of the automatic processor.

The mixture of the partial processing compositions is coated on an image forming surface of said silver halide light-sensitive photographic material preferably through a composition flow path. The composition flow path distance is preferably 5 mm to 150 mm.

The processing composition can be uniformly supplied and coated onto the image forming surface of the silver halide light-sensitive photographic material according to this.

The supply means to supply each of said partial compositions to said silver halide light-sensitive photographic material after mixing said partial compositions preferably comprises a control means to control volume of the mixture at-staying position at 1 to 100 ml.

By control the volume at staying position at 1 to 100 ml, adequate amount of compositions can be supplied whereby uneven development is avoided and compact automatic processor can be provided according to this.

A preferable example of the supply means is composed of stirring roller.

In this case, two partial compositions are supplied to the silver halide light sensitive material with simple means and stain of the parts of the automatic processor due to the leak of compositions are restrained.

The supply preferably comprises at least two composition supply exits which supply each of the partial-processing compositions, and the partial compositions are mixed between the composition supply exit and the silver halide light-sensitive photographic material.

According to this, two compositions employing a simple constitution are mixed and supplied to the silver halide light-sensitive photographic material and thus staining automatic processor members due to the dripping of a coating composition can be decreased.

An example of the shape of the composition supply exit is slit-like.

In this case staining automatic processor members due to the dripping of a coating composition can be decreased, and further, with a simple structure, the processing composition can be uniformly coated onto the image forming surface of a silver halide light-sensitive photographic material.

The automatic processor may comprise a cutting process before the process that the silver halide light-sensitive photographic material is coated.

According to this, the silver halide light sensitive material is cut before coating process and therefore rapid processing can be available and environmental adaptability is improved.

The automatic processor preferably comprises a contact angle control means which controls a contact angle of at least one of said processing compositions in respect to the circumference of said composition supply exit in the range of 5° to 60°.

By controlling the contact angle respect to the processing composition at 5° to 60°, it becomes possible to prepare the coating layer with uniform and appropriate thickness.

One example of the coating process is a developing process, and the processing composition for said development process is composed of a partial composition containing a developing agent and a partial composition containing an alkali agent.

In this case, the processing composition for development process is composed of a partial composition containing a developing agent and a partial composition containing an alkali agent, and prior to supplying it to the silver halide light-sensitive photographic material, both solutions are mixed together. Accordingly, the storage stability of the partial composition is improved, that is, specifically, the composition is subjected to neither deposition nor oxidation degradation, and furthermore, uneven processing due to fluctuation of the mixing ratio of two solutions is minimized.

Another example of the coating process is a bleach-fixing process, and the processing composition for said bleach-fixing process is composed of a partial composition containing a bleaching agent and a partial composition containing a fixing agent."

In this case, the processing composition for bleach-fixing process is composed of a partial composition containing a bleaching agent and a partial composition containing a fixing agent, and prior to supplying it to the silver halide light-sensitive photographic material, both solutions are mixed together. Accordingly, the storage stability of the partial composition is improved, that is, specifically, the composition is subjected to neither deposition nor oxidation degradation, and furthermore, uneven processing due to fluctuation of the mixing ratio of two solutions is minimized.

In case that the coating process is a bleach-fixing process, the above mentioned bleaching agent comprises at least one of ferric complex salts represented by general formulas (A), (I), (II), and (III) described below.

General formula (A)

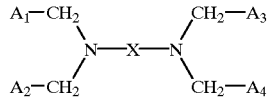

Wherein $A_1$, $A_2$, $A_3$, and $A_4$ are the same or different and each represents —$CH_2OH$, —COOM or —$PO_3M_1M_2$. M, $M_1$ and $M_2$ each represents a hydrogen atom, a sodium atom, a potassium atom, or an ammonium group. X represents a substituted or unsubstituted alkylene group having from 2 to 6 carbon atoms.

General formula (I)

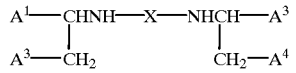

Wherein $A^1$, $A^2$, $A^3$, and $A^4$ each represents —$CH_2OH$, —$PO_3(M)_2$ or —COOM, and may be the same or different. M represents a cation. X represents an alkylene group having from 2 to 6 carbon atoms, or —$(B^1O)_n$—$B^2$—. N represents an integer of 1 to 8. $B^1$ and $B^2$ may be the same or different.

General formula (II)

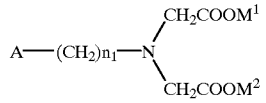

Wherein $n_1$ represents 1 or 2, and A represents —$COOM^3$, —OH, —$NH_2$ or —$PO_3(M^3)_2$. $M^1$, $M^2$, and $M^3$ each represents a hydrogen ion, an ammonium ion, a sodium ion, a potassium ion, a lithium ion, or an organic ammonium ion.

General formula (III)

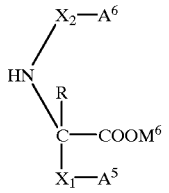

Wherein $A^5$ and $A^6$ each represents —$COOM^7$, —$PO_3(M^7)_2$, —$SO_3M^7$, a hydroxyl group, or a mercapto group, each may be the same or different. $M^6$ and $M^7$ each represents a cation. R represents a hydrogen atom, an aliphatic or aromatic group, and $X_1$ and $X_2$ each represents a divalent aliphatic group, a divalent aromatic group, or a divalent linking group composed of a divalent aromatic group or aliphatic group and an aromatic group."

The storage stability of the composition is improved, and the composition is subjected to neither deposit nor oxidation degradation, and non-uniform processing is minimized due to the fluctuation of the mixing balance of the two compositions.

The automatic processor comprises at least two reservoirs storing partial processing compositions separately, a supply means to supply each of said partial compositions to said silver halide light-sensitive photographic material and portions that the partial compositions are supplied are preferably substantially identical.

According to this, the portions that said partial compositions are supplied are substantially identical and the compositions are mixed before supplying to the silver halide light sensitive material. Accordingly, the storage stability of the partial composition is improved, that is, specifically, the composition is subjected to neither deposition nor oxidation degradation, and furthermore, uneven processing due to fluctuation of the mixing ratio of two solutions is minimized.

In this case it is preferable that a heating means which directly heats said silver halide light-sensitive photographic material is provided.

According to this, quick processing can be achieved by supplying a processing composition upon directly heating a silver halide light-sensitive photographic material.

In this case it is also preferable that the automatic processor comprises control means to control the total processing composition supply amount from said processing composition supply exit to said coating roller being at 10 to 160 ml per $m^2$ of said light-sensitive material.

By setting the total processing composition supply amount at 10 to 160 ml per $m^2$, the appropriate amount of the processing composition can be supplied to the coating and thus, it becomes possible to decrease the dimensions of the automatic processor. dr

Figure 1:
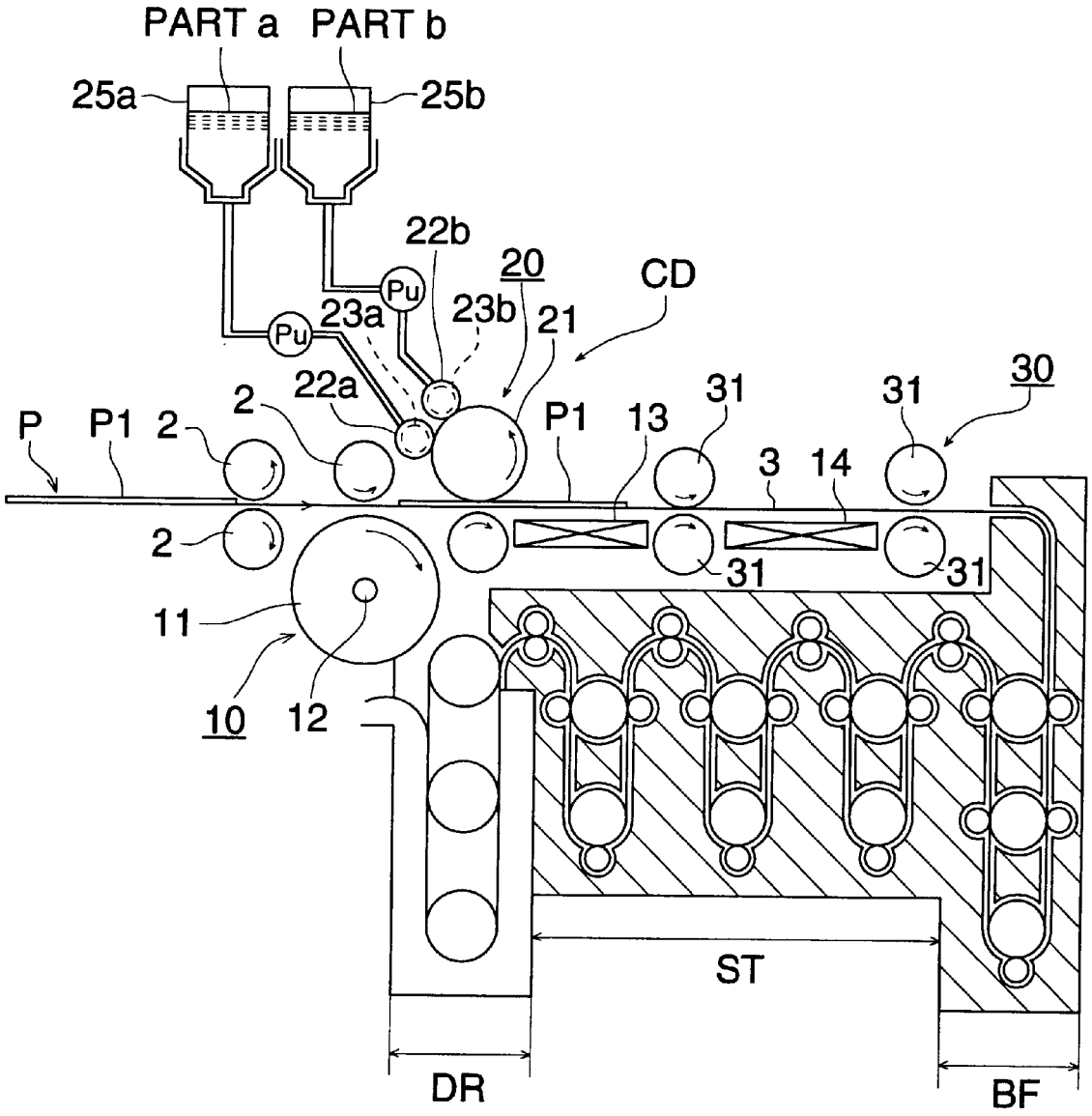
FIG. 1 is a schematic constitution view of a development process of an automatic processor for silver halide light-sensitive photographic materials.

FIGS. (14*a*) and (14*b*) are views explain the contact angle measurement method.

DETAILED DESCRIPTION OF THE INVENTION

The constitution of the present invention is described in detail below.

(Silver Halide Light-sensitive Photographic Material)

Silver halide light-sensitive photographic materials which are processed by the automatic processor for the silver halide light-sensitive photographic materials of the present invention include, for example, silver halide light-sensitive color photographic materials comprising a silver chloride emulsion; silver halide light-sensitive monochromatic photographic materials; silver halide light-sensitive color photographic materials comprising silver iodobromide or silver bromide emulsion; silver halide light-sensitive monochromatic photographic materials; etc.

The silver halide light-sensitive photographic materials which are processed by the automatic processor for silver halide light-sensitive photographic materials of the present invention preferably comprise at least one emulsion layer comprising a silver halide emulsion composed of not less than 90 mole percent of silver chloride in the silver halide composition. Furthermore, from the view of the effect of the present invention, the silver halide emulsion composed of 95 to 100 mole percent of silver chloride is preferred, but more preferred is that composed of 98 to 100 mole percent of silver chloride.

(Partial Composition)

The partial composition used in the present invention is a liquid component composed of processing composition to be coated on the light sensitive material. Processing composition to be coated on the light sensitive material is obtained by mixing partial compositions.

(Reservoir of the Partial Composition)

The reservoir concerning to the present invention is a container storing the partial composition. For the purpose of restraining the oxidation by air or vaporization, sealed container is preferable, and semi-sealed container is used. Specific shape includes a sealed cartridge and a semi-sealed tank. From the reservoir predetermined amount of the composition is forwarded to the supplying means through the mixing portion.

(Mixing Means of Partial Composition)

The mixing means concerning to the present invention is a means to mix the partial compositions before supplying to the light sensitive material. For obtaining uniform processing composition, it is preferable that the flow path is set as not less than 5 mm, stirring roller is provided or vibration is adopted.

More in detail, it is preferable to provide a mixing mechanism working for predetermined period at the connecting portion of at least two flow path. The mixing portion is composed of a merely connection of flow path of compositions and a mixing for predetermined period. In other way such a mixing means is preferable that at least two compositions are mixed by introduced through the each of flow path into the staying portion where the processing composition is coated on the light sensitive material. The other preferable mixing means is composed of a pair of rollers, that is, the partial compositions are introduced into the pair of rollers and mixed. Still other mixing means is composed of a supply exit and the light sensitive material which supply exit is provided with the composition supplying pipe and supplying at least two partial composition respectively. Concretely, the partial compositions flow out through the supply exit flow along the surface of the supply pipe, whereby the partial compositions are mixed at the flow path.

The mixing means concerning to the invention is provided at a portion prior to supplying the processing composition to the light sensitive material, preferably just before, and within 5 second more preferably.

(Supply Means)

In the present invention, the supply means is a means to supply a mixed processing composition consisting of at least two compositions to a silver halide light-sensitive photographic material and, for example, is composed of a outlet nozzle, composition staying or roller. Concretely it is composed of the composition flow path that is mixed processing composition is introduced into the outlet nozzle, composition staying or roller, flow out exit that forms a uniform composition layer on the roller or staying, and the exit nozzle or composition stay or roller that supplies the processing composition to the light sensitive material. "A processing composition is supplied by coating" described in the present invention shows that the processing composition is supplied to the light sensitive material by that the coating roller and the silver halide light-sensitive photographic material are brought into contact, a processing composition is blow onto a silver halide light-sensitive photographic material by outlet nozzle, a processing composition is pour into a silver halide light-sensitive photographic material by outlet nozzle or the light sensitive material runs through the composition stay.

The contact angle of the coating roller in respect to a processing composition is between 5° and 60°; preferably between 10° and 55°, and more preferably between 20° and 40°. These contact angles are preferred because the appropriate amount of the supplied coating composition becomes uniform on the coating roller. The coating roller is preferably a metal roller such as SUS, specifically, stainless steel (SUS 316L, SUS 316, SUS 304, and SUS 303), titanium (Ti), brass (Bs), etc. When a plastic roller or elastic Teflon roller is employed, a surface active agent is coated so as to decrease the contact angle. Furthermore, the coating roller comprising a hydrophilic material is preferred, that is, 6 nylon, N-methoxymethylpolyamide, polyurethane, polyacetal, etc. are preferably laminated. Coated surface active agents are preferred which can be oriented on a hydrophobic roller and direct a hydrophilic group to the surface. Accordingly, amphoteric surface active agents or alkylamine ethylene oxide compounds, etc. are preferably coated.

Figure 14:
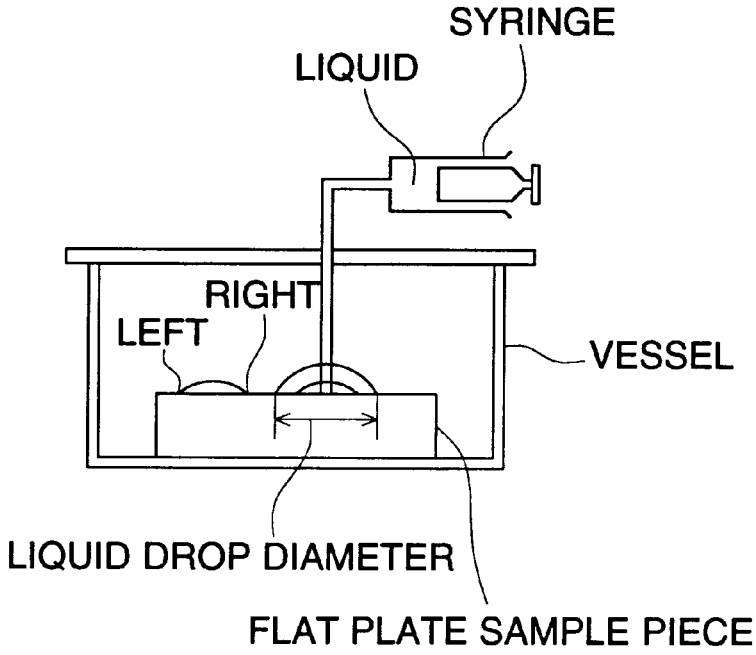
Figure 14:
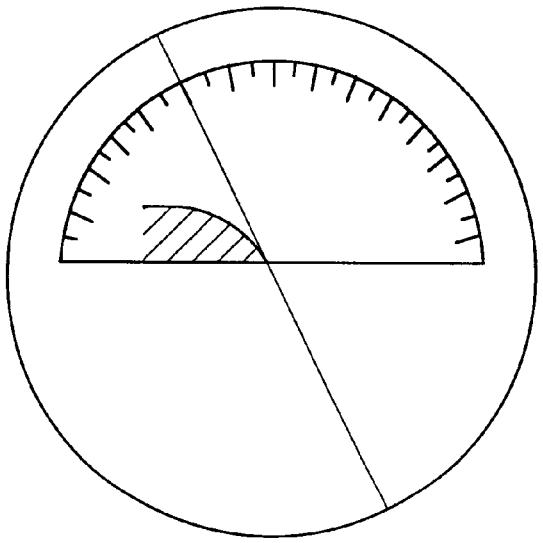

The contact angle of a coating roller in respect to a processing composition is measured employing a liquid drop method among contact angle measuring methods described in "Shin Zikken Kagaku Koza 18: Kaimen to Koroido (New Experimental Chemistry Lectures 18: Interface and Colloid)", page 97 (published by Maruzen, Oct. 20, 1977), while employing a flat plate sample which is prepared employing the same material and method as the surface material of the roller. Namely, as shown in FIG. 14(*a*), the flat plate sample having smoothness of mirror finish is horizontally placed in a vessel filled with the saturated vapor of a liquid to be measured. Employing a syringe, a tiny liquid drop is formed on the plate. The size of the drop is adjusted so that the contact diameter is approximately not more than 3 mm (there is a publication reporting that the acceptable drop volume is not more than 0.1 $cm^3$). The contact angle is generally measured employing a reading microscope (magnification is about 20 times) equipped with an angle gauge. FIG. 14(*b*) illustrates the principle. A liquid drop is forwardly illuminated with light transmitted through a milky glass or parallel light transmitted through a heat-ray absorbing glass. The measurement accuracy is ±1° and can be improved to ±0.5° when well practiced. The right and left angles of the liquid drop are measured, and when those angles exhibit a large difference, t he measurements for the drop are not accepted. Measuring angles are carried out for a liquid drop adding an liquid amount or after the liquid drop is left over some period of time and the variation in angles is inspected. Furthermore, measurements are carried out at several different positions on the same solid surface and measurements of at least ten positions are carried out and the average is obtained. Water employed for the measurement should be distilled water.

The composition supply exit is a slit formed in the axis direction of the coating roller, and staining the automatic processor members due to the dripping of a processing composition can be decreased, and further, with a simple structure, a processing composition can be uniformly coated and supplied onto the image forming surface of a silver halide light-sensitive photographic material.

Furthermore, the composition coating exit can be unified, and due to the unified composition coating exit, staining the automatic processor members due to the dripping of a processing composition can be decreased, and in addition, with a simple structure, a processing composition can be uniformly coated and supplied onto the image forming surface of a silver halide light-sensitive photographic material.

The preferable processing composition supply amount from this composition coating exit to the coating roller is set at 10 to 160 ml per $m^2$ of a light-sensitive material. When the processing composition supply amount is less than the set amount, a supply shortage is caused, when the amount is more than the set amount, the composition is wasted. By setting the total processing composition supply amount at 10 to 160 ml per $m^2$, the appropriate amount of the processing composition can be coated and supplied, and the dimensions of the automatic processor can be decreased. The supply amount is preferably between 10 and 120 ml per $m^2$ and more preferably between 20 and 60 ml per $m^2$. It is preferred to supply a more appropriate amount of the processing composition onto the coating roller.

Furthermore, the contact angle of at least one processing composition in respect to the circumference of the composition supply exit is preferably controlled between 5° and 60°. When the contact angle of a processing composition is less than the set angle, at coating, the coating layer becomes too thin, when the contact angle is more than the set angle, the coating layer becomes too thick. However, by controlling the contact angle of the processing composition between 5° and 60°, it is possible to prepare a uniform coating layer with an appropriate thickness.

The composition flow path length used in the invention is a minimum distance from the portion where the partial compositions are start mixing to the portion the processing composition is coated. The composition flow path length, until the processing composition supplied to this composition supply pipe, is coated onto the image forming surface of a silver halide light-sensitive photographic material is preferably set between 5 mm and 150 mm so that partial compositions can be fully mixed and aerial oxidation and evaporation of the processing composition is minimized. The length is more preferably between 7 and 100 mm and most preferably between 10 and 50 mm.

(Heating Means)

The temperature of a light-sensitive material heated by a heating means is preferably not lower than 45° C., more preferably not lower than 50° C., and most preferably not lower than 60° C. Furthermore, in terms of heat resistance of a light-sensitive material and control easiness of processing, the temperature is preferably not higher than 90° C. and further, in order to prevent a processing composition from boiling, the temperature is preferably not higher than 90° C. and most preferably not higher than 80° C.

The heating means employed to heat a light-sensitive material includes a conduction heat means in which a heat drum or heat belt is brought into contact with a light-sensitive material to heat the light-sensitive material through heat conduction; a convection heating means in which heating is carried out through convection employing a dryer; a radiation heating means employing radiation such as infrared ray, high frequency electromagnetic wave, etc.

Furthermore, when employing the conduction heat means, in order to minimize an adverse effect onto the emulsion surface of a light-sensitive material to be processed, a heating source is preferably brought into contact with the base side surface of a light-sensitive material on which no emulsion is coated.

Moreover, in the present invention, when a light-sensitive material is heated before supplying a processing composition onto the emulsion surface, in order to minimize the effect due to the difference in sensitivity caused by the temperature when the light-sensitive material is exposed, this light-sensitive material is preferably heated after exposing the light-sensitive material.

Furthermore, to avoid unnecessary heating, the heating means is preferably provided with a heat control means so that the heating means works according to the information on the presence of a silver halide light-sensitive photographic material. This can be achieved in such a manner that a conveyance means which conveys the silver halide light-sensitive photographic material at a predetermined conveyance speed, and a light-sensitive material detecting means which detects the presence of a silver halide light-sensitive material, at the predetermined position located in more advanced position of the conveyance direction of the conveyance means than the heating section of the heating means are provide, and according to the detection of the presence of the light-sensitive material, the heat control means is controlled. In this case, the heating means is preferably controlled so that it is operative immediately after the light-sensitive material detecting means detects the presence of a light-sensitive material at a predetermined position, immediately after the light-sensitive material detecting means detects the presence of a light-sensitive material after the elapse of a predetermined period of time, or until the predetermined period of time elapses.

(Color Development)

The color development processing time is a period of time when a light-sensitive material is first supplied with a color developing composition to when the light-sensitive material is supplied with a following processing composition (for example, bleach-fixing composition) or is immersed into the subsequent processing composition. The color processing time is preferably not shorter than 3 seconds and more preferably not shorter than 5 seconds in order to carry out sufficiently and stably the color development processing, and is preferably not longer than 20 seconds, more preferably not longer than 16 seconds and most preferably not longer than 12 seconds because adverse effects to the light-sensitive material, such as degradation of the color developer supplied to a light-sensitive material or formation of deposit due to drying can be minimized.

In the present invention, from the view point of quick processing, it is preferred to process with a thick processing composition. Namely, higher concentration gradient improves the diffusion into layers of a light sensitive material. Usually it was difficult to dissolve a color developing agent in high concentration. However it is found that it can be dissolved for short period, and the present invention has been attained.

Furthermore, when a processing composition is stored or rested, conventionally, the composition is subjected to aerial oxidation which causes problems such as formation of tar and stain. However, employing two partial compositions can minimize these problems.

The partial composition of the present invention containing a color developing composition comprises a color developing agent and preferably comprises preserving agents such as sulfite salts, hydroxylamines, cysteine, sulfinic acid, etc. The concentration of the color developing agent is between 10 and 150 g/liter, preferably between 15 and 100 g/liter, and most preferably between 20 and 80 g/liter.

Furthermore, as solubilizing agents, p-toluenesulfonic acid or sodium salt thereof, diethylene glycol, polyethylene glycol, triethanolamine, etc. are preferably incorporated.

In the processing composition of the present invention, compounds represented by general formula (I), or (SI) or (SII), or at least one selected from water-soluble siloxane series compounds are preferably incorporated.

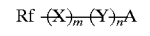

$$Rf\text{-}(X)_m\text{-}(Y)_n\text{-}A \qquad \text{General formula (I)}$$

Wherein Rf represents a saturated or unsaturated alkyl group containing at least one fluorine atom, and preferably an alkyl group having from 4 to 12 carbon atoms, and more preferably an alkyl group having from 6 to 9 carbon atoms. X represents sulfonamide, including:

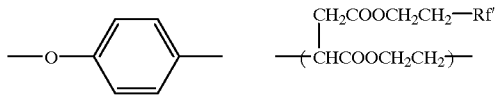

Y represents an alkylene oxide group, an alkylene group, etc. Rf' represents a saturated or unsaturated hydrocarbon group containing at least one fluorine atom. Further, A represents a hydrophilic group such as $—SO_3M$, $—OSO_3M$, —COOM, —$OPO_3(M_1)(M_2)$, —$PO_3(M_1)(M_2)$, etc.; preferably —$SO_3M$. M, $M_1$, and $M_2$ each represents H, Li, K, Na, or $NH_4$, and preferably Li, K, or Na, and most preferably Li. m represents 0 or 1; n represents 0 or an integer of 1 to 10, and preferably, m=0, n=0.

General formula (SIII)

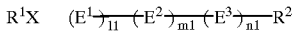

Wherein $R^1$ represents a hydrogen atom, an aliphatic group or an acyl group; $R^2$ represents a hydrogen atom or an aliphatic group. $E^1$ represents ethylene oxide; $E^2$ represents propylene oxide; $E^3$ represents ethylene oxide; X represents a oxygen atom or —$R^3$N— group, in which $R^3$ represents an aliphatic group, a hydrogen atom, or:

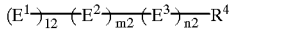

wherein $R^4$ represents a hydrogen atom or an aliphatic group. $l_1$, $l_2$, $m_1$, $m_2$, $n_1$, and $n_2$ each represents a value of 0 to 300.

General formula (SIII)

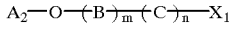

Wherein $A_2$ represents a monovalent organic group, for example, an alkyl group having from 6 to 50 carbon atoms, preferably from 6 to 35 carbon atoms (for example, a hexyl, heptyl, octyl, nonyl, decyl, undecyl, dodecyl group, etc.); or aryl group substituted by alkyl group having 3 to 35 carbon atoms or an alkenyl group having 2 to 35 carbon atoms. In case that $A_2$ is the aryl group substituted by alkyl group or an alkenyl group, it may be substituted by a fluorine atom.

A preferable substituent on the aryl group includes an alkyl group having 1 to 18 carbon atoms (such as methyl, ethyl, propyl, butyl, pentyl, hexyl, heptyl, octyl, nonyl, decyl, undecyl, dodecyl group, etc.), a substituted alkyl group such as a benzyl or phenetyl group, etc., or an alkenyl group having from 2 to 20 carbon atoms (for example, an unsubstituted alkenyl group such as a oleyl, acetyl, allyl group, etc., a substituted alkenyl group such as a styryl group, etc.). The aryl group includes a phenyl, biphenyl, or naphthyl group, etc., and preferably an phenyl group. The substituting position in the aryl group may be any of an ortho, meta, or para position and a plurality of substituents may be substituted.

B or C represents ethylene oxide or propylene oxide, or

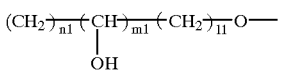

(note: $n_1$, m1, and $l_1$ each represents 0, 1, 2 or 3). m and n represents an integer of 0 to 100. $X_1$ represents a hydrogen atom or an alkyl group, an aralkyl group or an aryl group, for example, those groups described in $A_2$.

As siloxane series compounds, compounds represented by general formula (SU-1) described below are preferred.

General formula (SU-1)

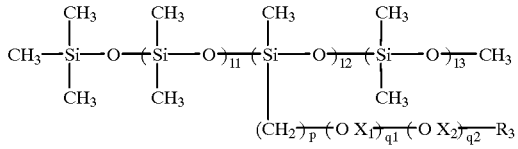

Wherein $R_9$ represents a hydrogen atom, a hydroxy group, a lower alkyl group, an alkoxy group,

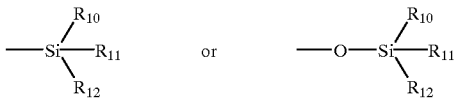

$R_{10}$, $R_{11}$, and $R_{12}$ each represents a hydrogen atom or a lower alkyl group, and may be the same or different. $l_1$, $l_2$, and $l_3$ each represents an integer of 0 to 30, and p, $q_1$, and $q_2$ each represents an integer of 1 to 30.

$X_1$ and $X_2$ each represents

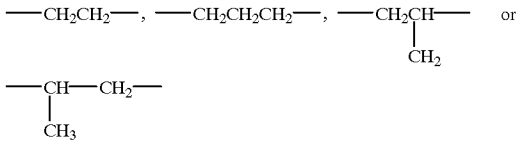

Specific examples are described in Japanese Patent Publication Open to Public Inspection No. 4-299340 and particularly preferred examples are shown below.

$C_8F_{17}SO_3K$ [I]-1

$C_8F_{17}SO_3Li$ [I]-2

$C_8F_{17}COONH_4$ [I]-3

$C_8F_{17}COOK$ [I]-4

[I]-5

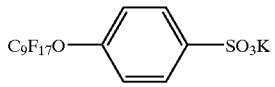

[I]-6

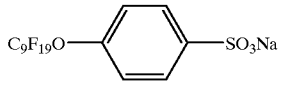

[I]-7

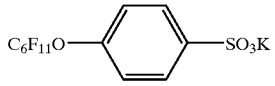

[I]-8

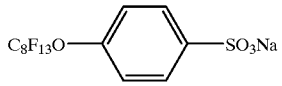

$C_7F_{15}CONHC_2H_4NC_5H_4Cl$ [I]-9

$C_7F_{15}COONH_4$ [I]-10

[I]-11

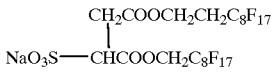

[I]-12

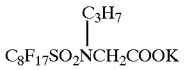

[I]-13

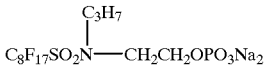

[I]-14

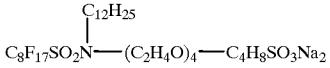

Of the compounds represented by the above-mentioned general formula (I), the most preferred compounds are those represented by (I-1), (I-2), (I-4), and (I-9).

These compounds can be synthesized according to ordinary methods and are also commercially available.

(Compounds Represented by General Formula (SI))

SI-1

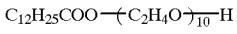

SI-2

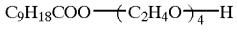

SI-3

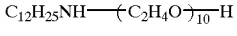

SI-4

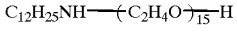

SI-5

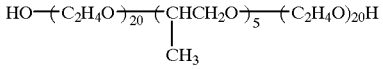

SI-6

SI-7

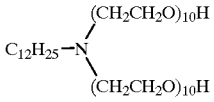

SI-8

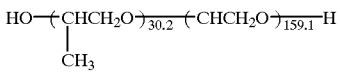

SI-9

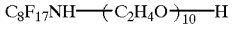

(Compounds Represented by General Formula (SII))

SII-1

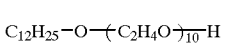

SII-2

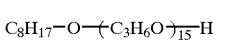

SII-3

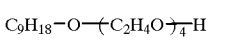

SII-4

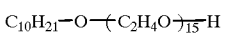

SII-5

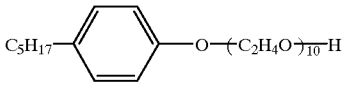

-continued

SII-6

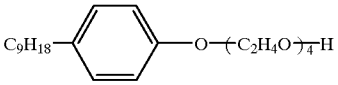

SII-7

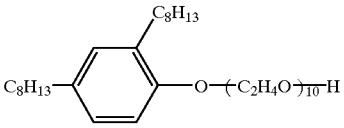

SII-8

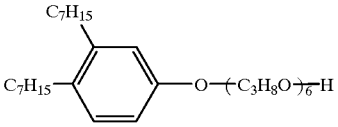

SII-9

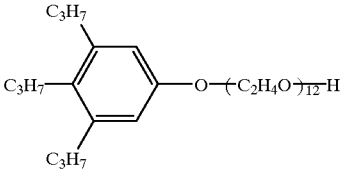

SII-10

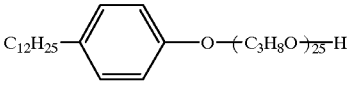

SII-11

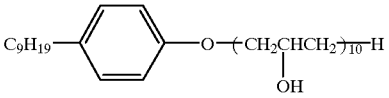

SII-12

SII-13

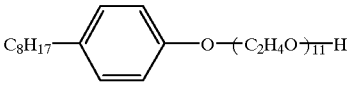

SII-14

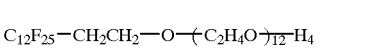

SII-15

SII-16

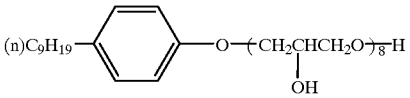

SII-17

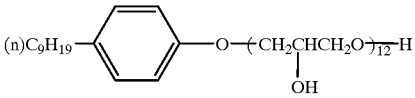

SII-18

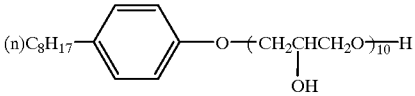

SII-19

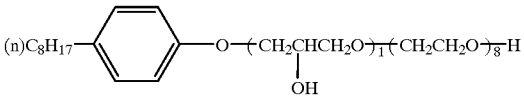

(Water-soluble Siloxane Series Compounds)

SU-I-1

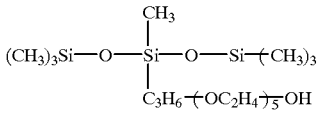

SU-I-2

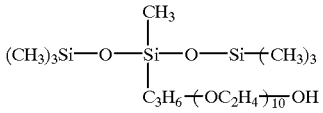

SU-I-3

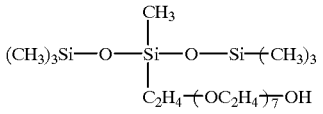

SU-I-4

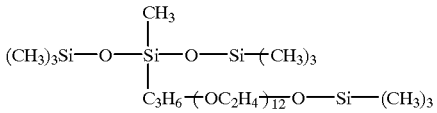

SU-I-5

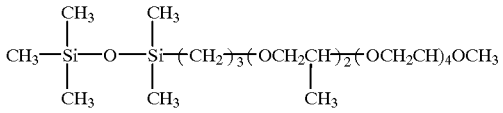

SU-I-6

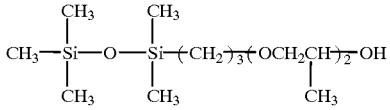

SU-I-7

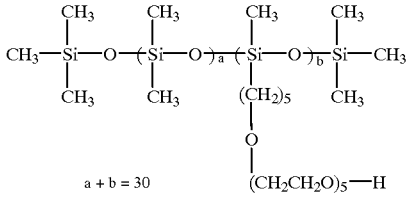

Of the compounds the most preferred compounds are those represented by (SII-5), (SII-11), (SII-13), (SII-15) and (SU-I-1).

The alkali agent-containing partial composition of the present invention is composed of alkali agents such as potassium carbonate, potassium hydroxide, etc. and preferably comprises a solubilizing agent of the above-mentioned developing agent and a surface active agent. The pH is preferably between 10 and 14 and more preferably between 12 and 13.5. When the concentration of these alkali agents is excessively high, swelling of the emulsion layer of a silver halide light-sensitive photographic material is hindered. Therefore the added amount of a fixing agent is preferably between 30 and 200 g/liter and more preferably between 50 and 120 g/liter.

As the ratio of the composition volume of a supplied color developing composition, the volume of one partial composition is preferably between 0.01 and 100 times that of the other partial composition; more preferably between 0.1 and 10 times, and most preferably between 0.5 and 2 times.

The total volume of the bleach-fixing composition supplied onto the emulsion layer of a silver halide light-sensitive photographic material is preferably between 10 and 160 ml per $m^2$ of the light-sensitive material; more preferably between 10 and 120 ml, and most preferably between 20 and 100 ml.

The supply volume of the color developing composition to a silver halide light-sensitive photographic material is preferably proportional to the exposure amount to the light-sensitive material.

The preferred examples of the supply order of a bleach-fixing composition are shown below:

(1) Color development→Bleach-fixing→Stabilization.

(2) Color development→Bleaching→Fixing→Stabilization.

(3) Color development→Bleaching→Bleach-fixing→Stabilization.

(4) Color development→Bleach-fixing→Bleaching→Stabilization.

(5) Color development→Bleach-fixing→Bleach-fixing→Stabilization.

(6) Color development→Fixing→Bleach-fixing→Stabilization.

(7) Color development→Bleaching→Bleach-fixing→Fixing→Stabilization.

(8) Black and white development→Washing→Reversing→Color development→Washing Adjustment→Bleaching→Fixing→Stabilization.

(9) Black and white development→Washing→Reversing→Color development→Washing→Adjustment→Bleach-fixing→Stabilization.

Of these, as preferred examples, (1), (2) and (3) are listed.

Specific examples of p-phenylenediamine series compounds which are preferably employed in the present invention include the following.

(C-1)

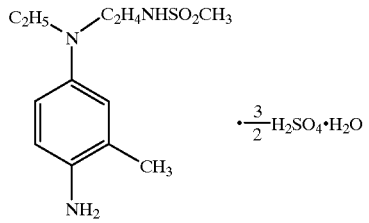

(C-2)

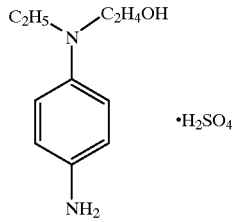

(C-3)

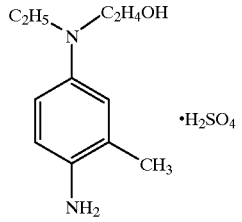

-continued
(C-4)
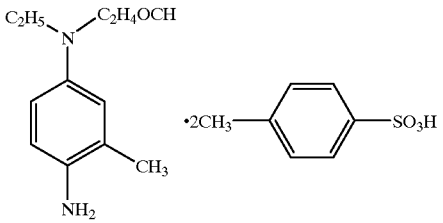
(C-5)
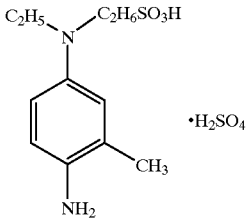
(C-6)
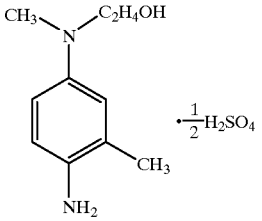
(C-7)
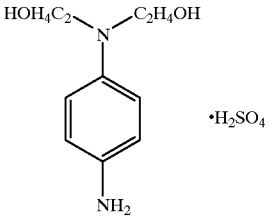
(C-8)
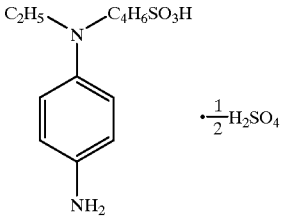
(C-9)
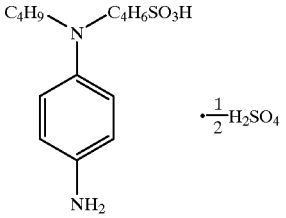
-continued
(C-10)
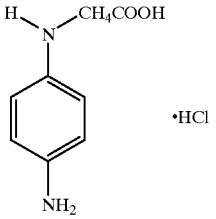
(C-11)
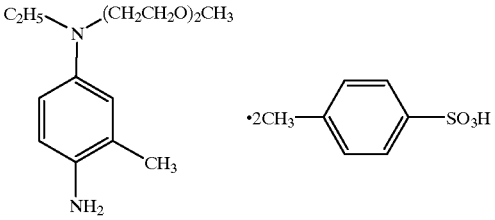
(C-12)
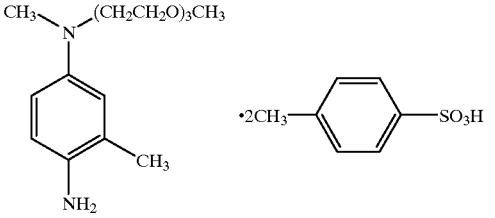
(C-13)
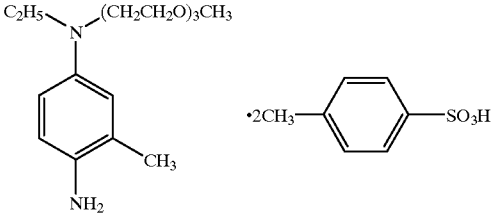
(C-14)
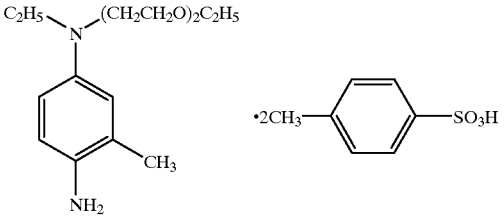
(C-15)
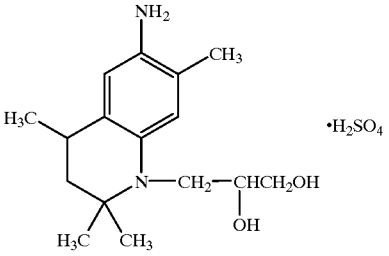

-continued (C-16)

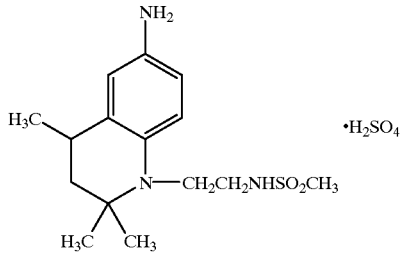

Of the exemplified color developing agents mentioned above, those preferred, from the point of the effect of the present invention, are (C-1), (C-2), (C-3), (C-4), (C-6), (C-7), and (C-15). (C-3) is particularly preferred. The above-motioned p-phenylenediamine series compounds are generally employed in the form of chloride salts, sulfate salts, p-toluene sulfate salts.

(Bleach-Fixing Process)

The present invention is provided with the bleach-fixing process. The processing composition of the above-mentioned process is composed of at least two compositions consisting of a partial composition containing a bleaching agent and a partial composition containing a fixing agent. Both of the partial compositions is mixed just before being supplied to a silver halide light-sensitive photographic material. Thus, the storage stability of the compositions is improved, and specifically, the composition is subjected to neither deposition nor oxidation degradation, and further, uneven processing due to fluctuation of the mixing ratio of two compositions is minimized.

In this bleach-fixing process, the bleaching agents are comprised of at least one of the ferric complex salts of the compounds represented by the above-mentioned general formulas (A), (I), (II), and (III). A partial bleaching composition containing at least one of ferric complex salts of the compounds represented by general formulas (A), (I), (II), and (III) is mixed just before being supplied to a silver halide light-sensitive photographic material. Thus, the storage stability of the compositions is improved, and specifically, the composition is subjected to neither deposition nor oxidation degradation, and further, uneven processing due to fluctuation of the mixing ratio of two compositions is minimized.

I-1

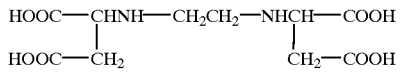

I-2

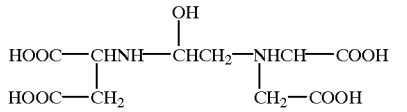

I-3

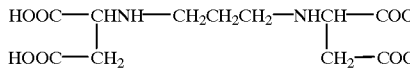

I-4

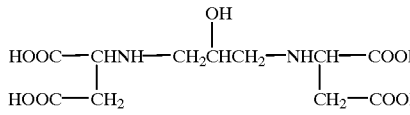

-continued

I-5

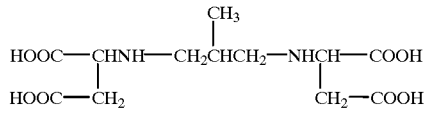

I-6

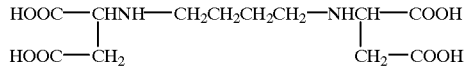

I-7

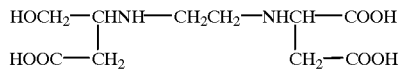

I-8

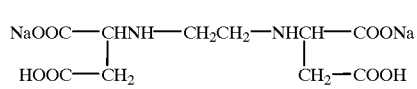

I-9

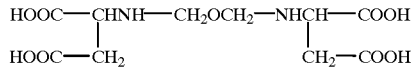

I-10

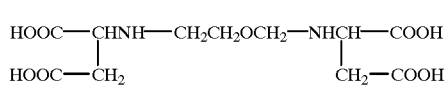

I-11

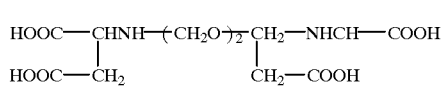

I-12

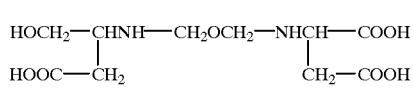

I-13

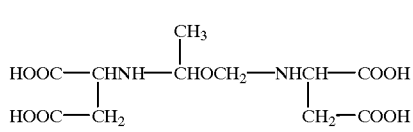

I-14

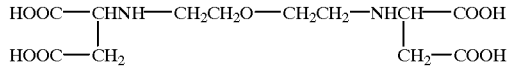

I-15

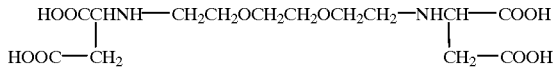

I-16

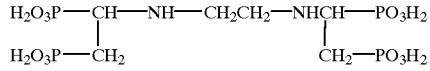

I-17

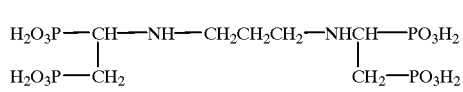

Of these, the particularly preferred compounds are (I-1), (I-3), (I-5), and (I-15), and the more preferred compounds are (I-1) and (I-3).

A-1

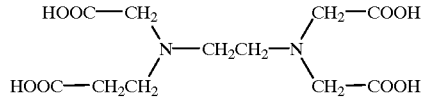

-continued

A-2

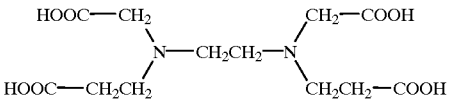

A-3

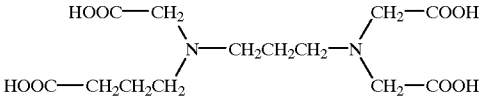

A-4

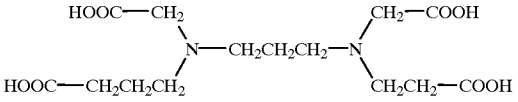

A-5

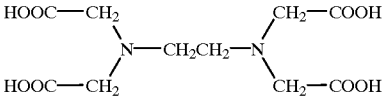

A-6

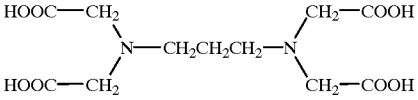

A-7

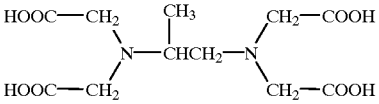

A-8

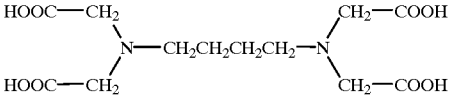

A-9

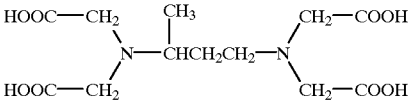

A-10

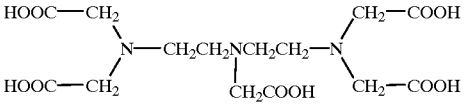

Of these, the particularly preferred compounds are (A-1), (A-5), (A-6) and (A-10)

The compounds represented by the above-mentioned general formulas can be synthesized by employing generally known methods described in Zh. Obshch. Khim., 49 659 (1979), Inorganic Chemistry, Vol. 7, 2505 (1968), Chem. Zresti, 32, 37 (1978), U.S. Pat. No. 3,158,635, Japanese Patent Publication Open to Public Inspection No. 5-303186, etc.

In the following, there are listed the preferred specific examples represented by the above-mentioned general formula (II), which are employed as a silver halide light-sensitive photographic material processing composition having a bleach function of the present invention and are employed to process the silver halide light-sensitive photographic material.

II-1

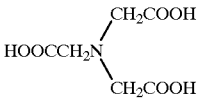

II-2

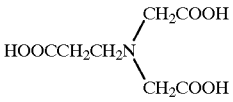

II-3

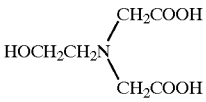

II-4

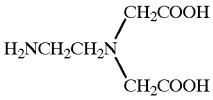

II-5

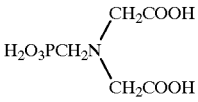

II-6

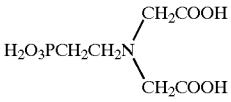

Of these, particularly preferred compounds are (II-1), (II-2), and (II-3).

In the following, there are listed the preferred specific examples represented by the above-mentioned general formula (III), which are employed as a silver halide light-sensitive photographic material processing composition having a bleach function of the present invention and are employed to process the silver halide light-sensitive photographic material.

III-1

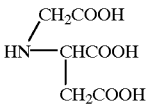

III-2

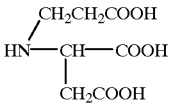

III-3

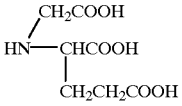

III-4

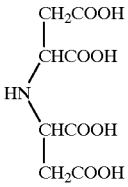

-continued

III-5

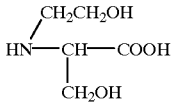

III-6

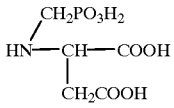

III-7

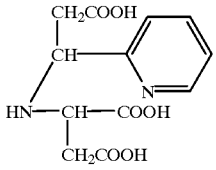

Generally, the above-mentioned bleaching agents are employed as sodium salts, ammonium salts or potassium salts.

Furthermore, a partial composition containing a bleaching agent preferably contains an organic acid compound represented by general formula (B) mentioned below.

$B(—COOM)_n$ General formula (B)

wherein B represents an n valent organic acid; n represents an integer of 1 to 6, and M represents an ammonium, an alkali metal (sodium, potassium, lithium, etc.) or a hydrogen atom.

In the general formula (A), n valent organic acids represented by A include an alkylene group (for example, a methylene group, an ethylene group, a trimethylene group, a tetramethylene group), an alkenylene group (for example, ethenylene group), a cycloalkynylene group (for example, 1,4-cyclohexandyl group), arylene group (for example, o-phenylene group, p-phenylene group), alkantolyl, etc. (for example, 1,2,3-propanetolyl group), arylenetolyl group (for example, 1,2,3-benzenetolyl group).

The above mentioned n valent groups represented by B comprise those (for example, 1,2-dihydroxyethylene, hydroxyethylene, 2-hydroxy-1,2,3-propanetolyl, methyl-p-phenylene, 1-hydroxy-2-chloroethylene, chloromethylene, chloroethenylene) having a substituent (for example, a hydroxy group, an alkyl group, a halogen atom). Preferred specific examples of compounds represented by general formula (B) are shown below.

$HOOCCH_2C(OH)(COOH)CH_2COOH$ B-1

$HOOC(CHOH)_2COOH$ B-2

$HOOCCH_2COOH$ B-3

$HOOCCH(OH)CH_2COOH$ B-4

B-5

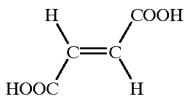

-continued

B-6

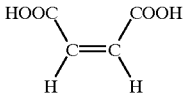

B-7

$(COOH)_2$

B-8

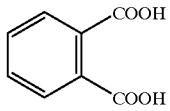

B-9

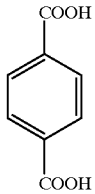

B-10

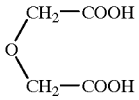

B-11

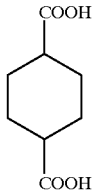

B-12

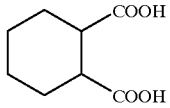

$HOOC—(CH_2)_3—COOH$ B-13

$HOOC—(CH_2)_4—COOH$ B-14

$HOOCC≡CCOOH$ B-15

B-16

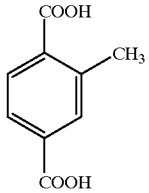

B-17

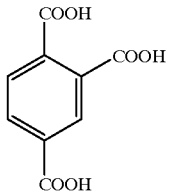

-continued

B-18

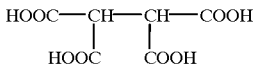

B-19

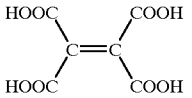

$HO—CH_2—COOH$ B-20

Of the above exemplified compounds, those particularly preferred are exemplified compounds (B-1), (B-2), (B-3), (B-4), (B-5), (B-6), (B-13), (B-14), (B-15), and (B-20), and the most preferred compounds are (B-1), (B-5), (B-6), (B-13), (B-14), and (B-20). Furthermore, salts of the above mentioned acids include ammonium salts, lithium salts, sodium salts, potassium salts, etc. However, in terms of storage stability, sodium salts and potassium salts are preferred. These organic acids and salts thereof may be employed individually or in a combination of two or more.

Furthermore, a partial composition containing a bleaching agent may contain a rehalogenating agent. As the rehalogenating agents, those known in the art can be employed and include compounds such as ammonium bromide, potassium bromide, sodium bromide, potassium bromide, sodium chloride, ammonium chloride, potassium iodide, sodium iodide, ammonium iodide, etc.

The added amount of organic acid ferric complex salts is preferably in the range of 0.1 to 2.0 moles per liter of a partial composition containing the bleaching agent, and more preferably in the range of 0.15 to 1.5 moles per liter.

When at least one of imidazole and derivatives thereof and compounds represented by general formulas (I) through (IX) and exemplified compounds thereof described in Japanese Patent Publication Open to Public Inspection No. 64-295258 is incorporated into a partial composition containing a bleaching agent, the processing may be accelerated.

Other than the above-mentioned accelerating agents, exemplified compounds described on pages 51 to 115 of Japanese Patent Publication Open to Public Inspection No. 62-123459; exemplified compounds described on pages 22 to 25 of Japanese Patent Publication Open to Public Inspection No. 63-17445, and compounds described in Japanese Patent Publication Open to Public Inspection Nos. 53-95630 and 53-28426 are employed in the same manner.

The pH of the partial composition containing a bleaching agent is preferably not more than 6.0 and more preferably between 1.0 and 5.5.

Various fluorescent brightening agents or surface active agents can be incorporated into the bleaching agent-containing partial composition. As fixing agents employed in a partial composition containing a fixing agent according to the present invention, thiocyanate salts and thiosulfate salts are preferably employed. The content amount of the thiocyanate salt is preferably not less than 0.1 mole per liter. When processing a color negative film, the content is more preferably not less than 0.5 mole per liter and most preferably 1.0 mole per liter. Furthermore, the content of a thiosulfate salt is preferably not less than 0.2 mole per liter, and when processing a color negative film, is preferably not less than 0.5 mole per liter. In addition, in the present invention, by employing the thiocyanate salt together with a thiosulfate salt, the object of the present invention can be more effectively accomplished.

The fixing composition or bleach-fixing composition according to the present invention can be comprised individually or in a combination of two or more pH buffer agents composed of various salts other than these fixing agents. Furthermore, a large amount of rehalogenating agents such as alkali halides or ammonium halides, for example, potassium bromide, sodium bromide, sodium chloride, ammonium bromide, etc. are preferably incorporated. Furthermore, alkylamines, polyethylene oxides, etc., which are generally known as compounds to be added to a fixing composition or bleach-fixing composition can be appropriately incorporated. The pH of the fixing composition is preferably in the range of 4 to 8.

Compounds represented by general formula (FA) and exemplified compounds thereof described on page 56 of Japanese Patent Publication Open to Public Inspection No. 64-295258 are preferably incorporated into a processing composition containing fixing agents. The incorporation of these compounds preferably enhances the advantage of the present invention. In addition, another advantage is exhibited in that sludge formation is minimized which is formed in the processing composition having a fixing function during processing a small amount of light-sensitive materials over an extended period of time.

The bleach-fixing time is a period from when a light-sensitive material is first supplied with a partial composition containing a bleaching agent to when the light-sensitive material is supplied with a following processing composition or is immersed into the-following processing composition. The color development processing time is preferably not less than 3 seconds, and more preferably not less than 5 seconds in order to conduct bleach-fixing efficiently and stably, and preferably not more 20 seconds, more preferably not more 16 seconds, and most preferably not more than 12 seconds because adverse effects to a light-sensitive material, such as the degradation of the bleach fixing composition supplied to a light-sensitive material, the formation of deposition upon drying, etc. can be minimized.

The added amount of a fixing agent is preferably between 30 and 200 g/liter and more preferably between 50 and 120 g/liter.

As the ratio of the composition volume of a supplied bleach-fixing composition, the volume of one partial composition is preferably between 0.01 and 100 times that of the other partial composition; more preferably between 0.1 and 10 times, and most preferably between 0.5 and 2 times.

The total volume of the bleach-fixing composition supplied onto the emulsion layer of a silver halide light-sensitive photographic material is preferably between 10 and 160 ml per $m^2$ of the light-sensitive material; more preferably between 10 and 120 ml, and most preferably between 20 and 100 ml.

The supply volume of the bleach-fixing composition to a silver halide light-sensitive photographic material is preferably proportional to the exposure amount to the light-sensitive material.

EMBODIMENTS OF THE INVENTION

The embodiment of an automatic processor for silver halide light-sensitive photographic materials of the present invention is explained in detail with reference to the figures below. In this embodiment, the development process of the automatic processor for silver halide light-sensitive photographic materials is described. The description is applied to fixing, washing processes, etc. in the same manner.

EXAMPLE 1

Figure 2:
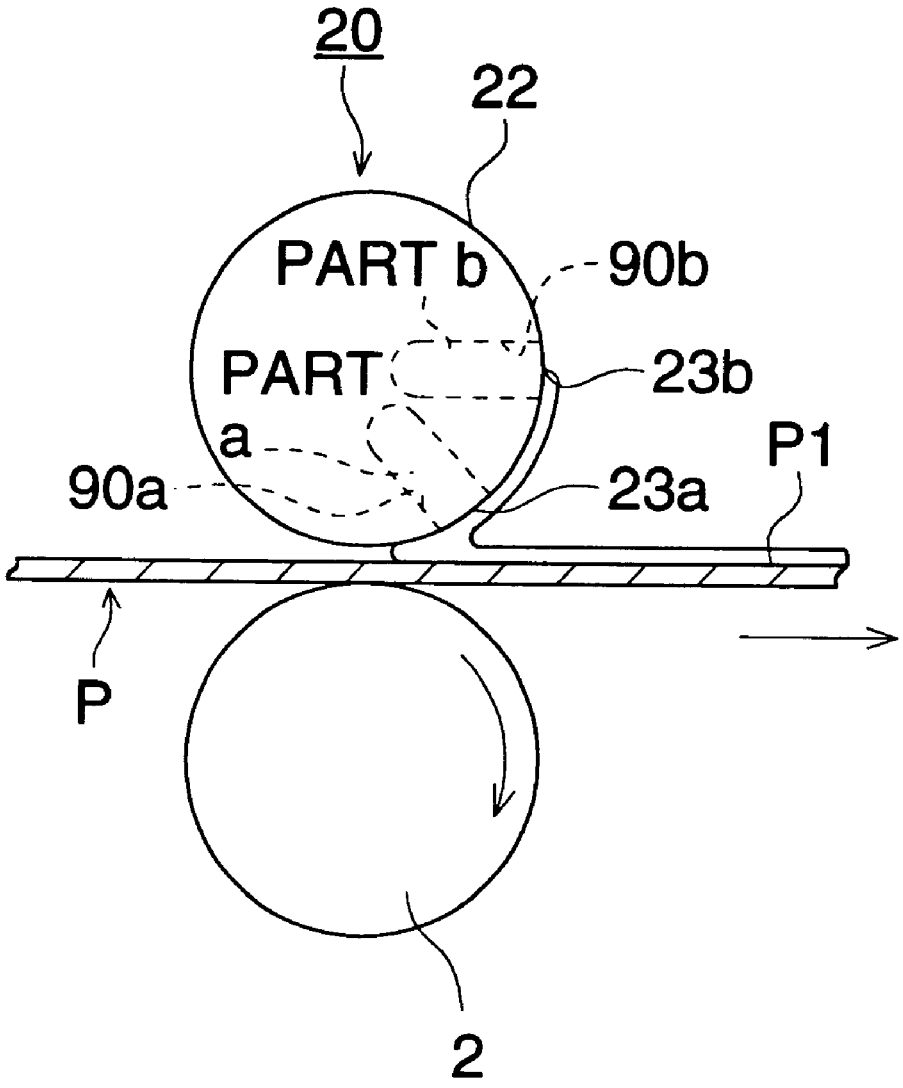
FIG. 2 is an enlarged schematic constitution view of a coating supply section.

FIG. 1 is a schematic constitution view of a development process of an automatic processor and FIG. 2 is an enlarged schematic constitution view of a coating supply section. In this automatic processor, a development process CD, a bleach-fixing process BF, a stabilizing process ST, and a drying process DR are provided. In this development process CD, a conveyance path 3 is formed which conveys a silver halide light-sensitive photographic material P, employing a plurality of conveyance rollers 2, and this conveyance path is provided in the horizontal direction. The silver halide light-sensitive photographic material P is cut into a sheet before being conveyed to the development process CD, and is conveyed while an image forming surface P1 is positioned in the upper side. In the conveyance path 3 conveying the silver halide light-sensitive photographic material P, a preheat section 10, a coating supply section 20, and a squeeze section 30 are arranged in the order of the light-sensitive material conveying direction.

In the preheat section 10, the conveyance roller 2 is arranged in the upper side of the conveyance path 3 and a heat roller 11 is arranged in the lower side of the conveyance path 3, while facing the conveyance roller 2. In the heat roller 11, a heater 12 is built in and this heat roller 11 constitutes a heating means to supply heat to the silver halide light-sensitive photographic material P to conduct processing. The silver halide light-sensitive photographic material P is heated to the range of 45 to 95° C., more preferably to the range of 50 to 90° C., and most preferably to the range of 60 to 80° C., at which advantages of the present invention are improved.

In the coating supply section 20, a composition supplying pipe 22 which coats the processing composition onto the image forming surface P1 of the silver halide light-sensitive photographic material P is provided, and the interia of the supplying pipe 22 is divided two chambers 90*a* and 90*b*. Partial composition a and partial composition b are filled in the chambers 90*a* and 90*b* respectively. The partial compositions are ejected out through the supply exits 23*a* and 23*b*, and they are mixed during the time of flowing along with the wall of a composition supply pipe 22.

The processing composition supply means 22*a* and 22*b* each supplies processing compositions a and b from processing tanks 25*a* and 25*b* via a pump Pu such as a bellows pump or a tube pump.

Furthermore, the processing composition supply amount from the composition supply outlets 23*a* and 23*b* constituting a mixing means to the image forming surface P1 of the silver halide light-sensitive photographic material P is set at 10 to 160 ml per $m^2$. When the total processing composition supply amount is less than the set amount, a supply shortage is caused, while when the total amount is more than the set, the processing composition is wasted. By setting the total processing composition supply amount at 10 to 160 ml per $m^2$, an appropriate amount of the processing composition can be supplied.

Furthermore, the composition flow path length L1 on the processing composition supply pipe 22, until the processing composition supplied from the composition supply outlets 23*a* and 23*b* is coated onto the image forming surface P1 of the silver halide light-sensitive photographic material P, is set at 5 mm to 150 mm, and the processing compositions supplied onto the processing composition supply pipe 22 is homogeneously mixed, and the processing composition can be uniformly coated onto the image forming surface P1 of the silver halide light-sensitive photographic material P to enable quality processing without causing uneven processing. When the composition flow path length L1 is less than the set length, the processing composition supplied onto the processing composition supply pipe 22 is coated, before mixed homogeneously, onto the image forming surface P1 of the silver halide light-sensitive photographic material P, while the composition flow path length L1 is more than the set, the processing composition is degraded due to oxidation.

The contact angle of the processing composition supply pipe 22 in respect to a processing composition is between 5° and 60°; preferably between 10° and 50°, and more preferably between 20° and 40°. These contact angles are preferred because the appropriate amount of the supplied processing composition becomes uniform on the processing composition supply pipe. The processing composition supply pipe 22 is preferably a metal pipe such as SUS, and specifically, stainless steel (SUS 316L, SUS 316, SUS 304, and SUS 303), titanium (Ti), brass (Bs), etc. are preferred. When a plastic pipe or elastic Teflon pipe is employed, a surface active agent is coated to decrease the contact angle. Furthermore, the processing composition supply pipe 22 comprising a hydrophilic material is preferred, that is, 6 nylon, N-methoxymethylpolyamide, polyurethane, polyacetal, etc. are preferably laminated. Coated active agents are preferred which orient onto a hydrophobic pipe and direct a hydrophilic group to the surface. Accordingly, amphoteric surface active agents or alkylamine ethylene oxide compounds, etc. are preferably coated.

In the squeeze section 30, squeeze rollers 31 are arranged so as to face each other over and under the conveyance path 3, and the upper side which is in contact with the image forming surface P1 of the silver halide light-sensitive material may only be of a squeeze roller. In this case, the lower side is of a conveyance roller. The squeeze roller 31 is arranged in a later position than the processing composition supply pipe 22 in the light-sensitive material conveying direction and the developing composition supplied onto the silver halide light-sensitive material P is squeezed to become uniform. Furthermore, heaters 13 and 14 are arranged under the conveyance path 3.

Generally a water absorbing sponge roller is used as the squeeze roller 31. However, in the present invention, a less water absorbing roller is preferred, and a metal roller such as SUS, etc., a plastic roller, a rubber roller, a woven fabric roller, a nonwoven fabric roller, and a sintered body roller are preferred. Specifically, as the metal rollers, stainless steel (SUS316L, SUS316, SUS304, SUS303), aluminum (Al), titanium (Ti), brass (Bs), etc. are preferred. Furthermore, regarding the plastic rollers, preferred materials for the squeeze roller include polyethylene terephthalate (PET), polyethylene (PE), ethylene tetrafluoride-perfluoroalkoxyethylene copolymer resin (PFA), polyacetal (POM), polypropylene (PP), polyethylene tetrafluoride (PTFE), polyvinyl chloride (PVC), phenol resin (PF), modified polyphenylene ether (PPE), modified polyphenylene oxide (PPO), polyurethane (PU), polycarbonate (PC), polyphenylene sulfide (PPS), polyvinylidene fluoride (PVDF), ethylene tetrafluoride-propylene hexafluoride copolymer resin (FEP), ethylene tertafluoride-ethylene copolymer resin (ETFE). As rubber rollers, ethylene propylene rubber (EPDM, EPM), silicone rubber (Si), nitrile rubber (NBR), chloroprene rubber, etc. are preferred. As materials of the woven fabric and nonwoven fabric, polyolefin series fiber, polyester series fiber, polyacryronitrile series fiber, aliphatic polyamide fiber, aromatic polyamide fiber, polyphenylene sulfide fiber, etc. are preferred. Furthermore, a roller coated with Teflon is more preferred.

Figure 3:
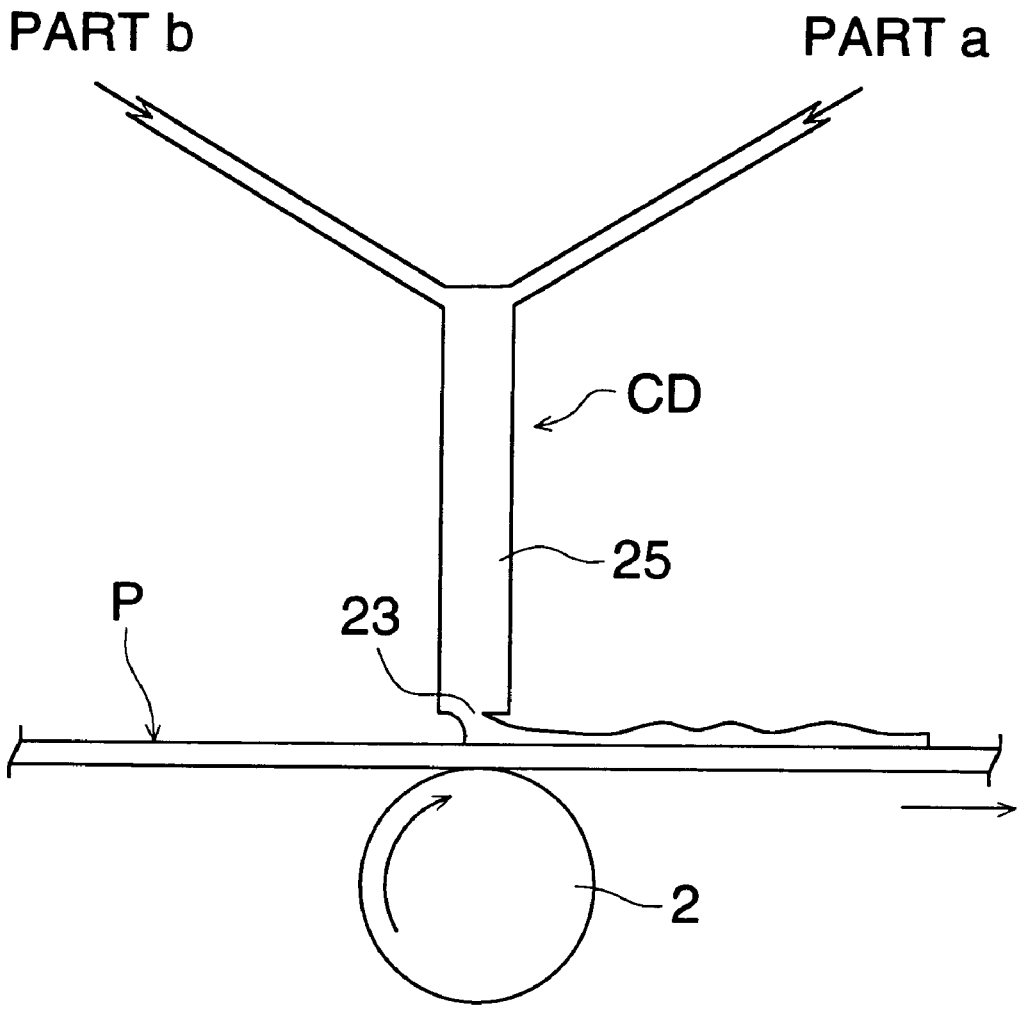
FIG. 3 is an enlarged schematic constitution view of a coating supply section.

FIG. 3 is a schematic constitution view of another embodiment of coating section of the automatic processor for silver halide light-sensitive photographic materials. Partial compositions a and b are mixed at large volume mixing section 25, and the mixture is supplied to a light sensitive material P1 through outlet 23. The light sensitive material P1 is transported by transport roller 2.

Figure 4:
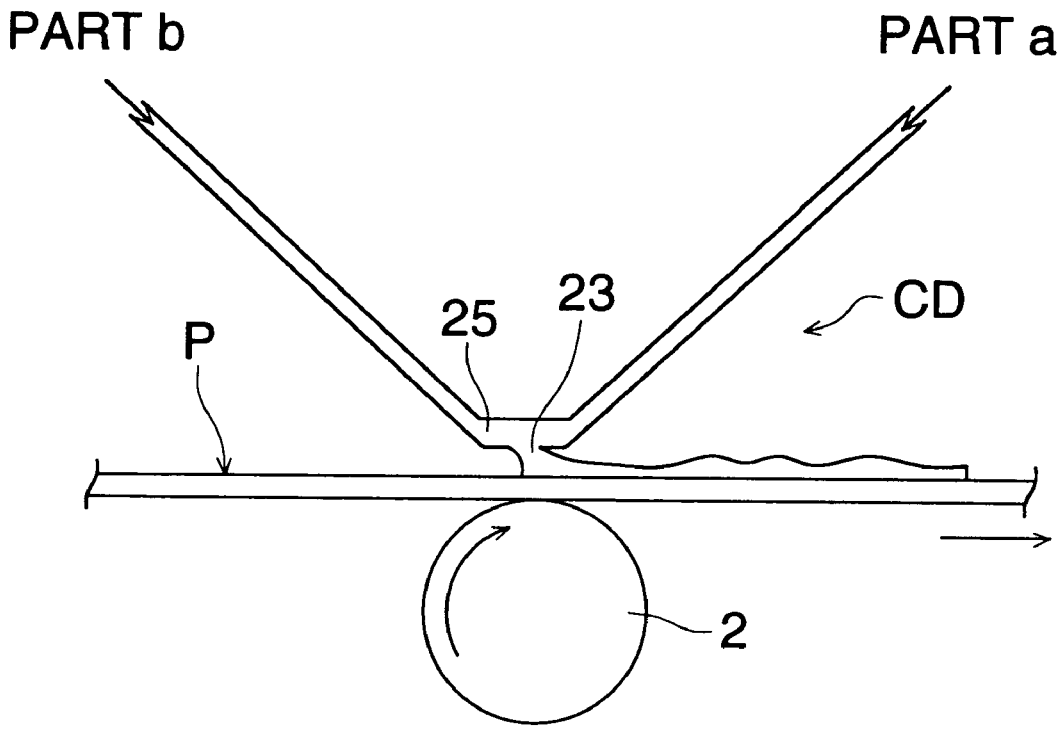
FIG. 4 is an enlarged schematic constitution view of a coating supply section.

FIG. 4 is a schematic constitution view of another embodiment of coating section of the automatic processor for silver halide light-sensitive photographic materials. Partial compositions a and b are mixed at small volume mixing section 25, and the mixture is supplied to a light sensitive material P1 through outlet 23. The light sensitive material P1 is transported by transport roller 2.

Figure 5:
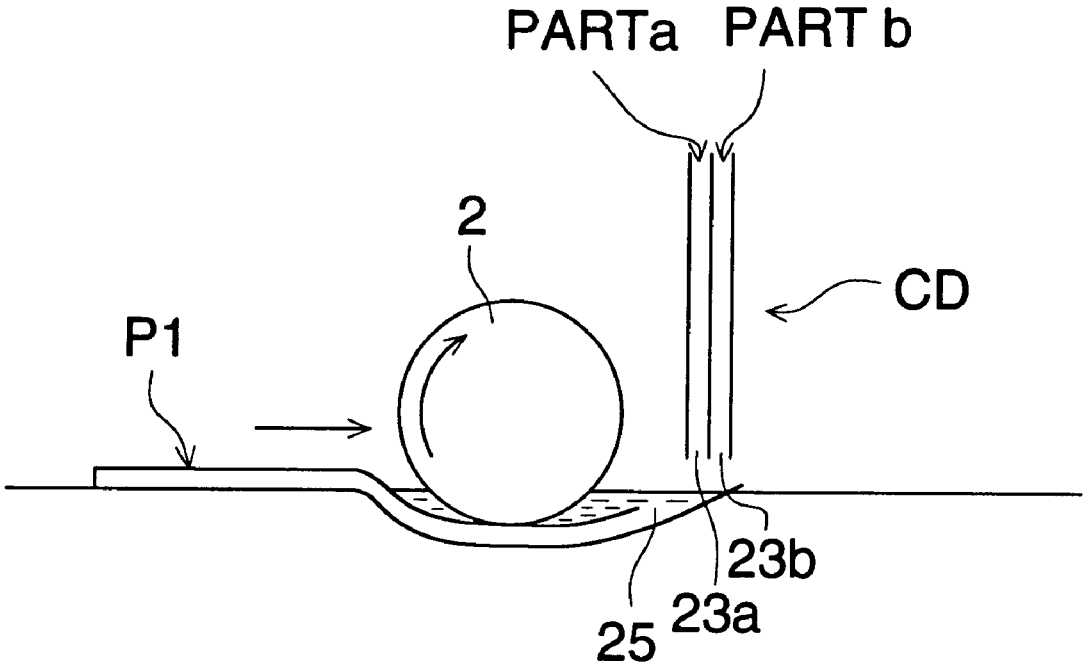
FIG. 5 is an enlarged schematic constitution view of a coating supply section.

FIG. 5 is a schematic constitution view of another embodiment of coating section of the automatic processor for silver halide light-sensitive photographic materials. Partial compositions a and b are supplied to mixing section 25 provided in the transporting path as concave form, where they are mixed, and the mixture is supplied to a light sensitive material P1. The transport roller 2 rotates so as to accelerate the mixing of partial compositions.

Figure 6:
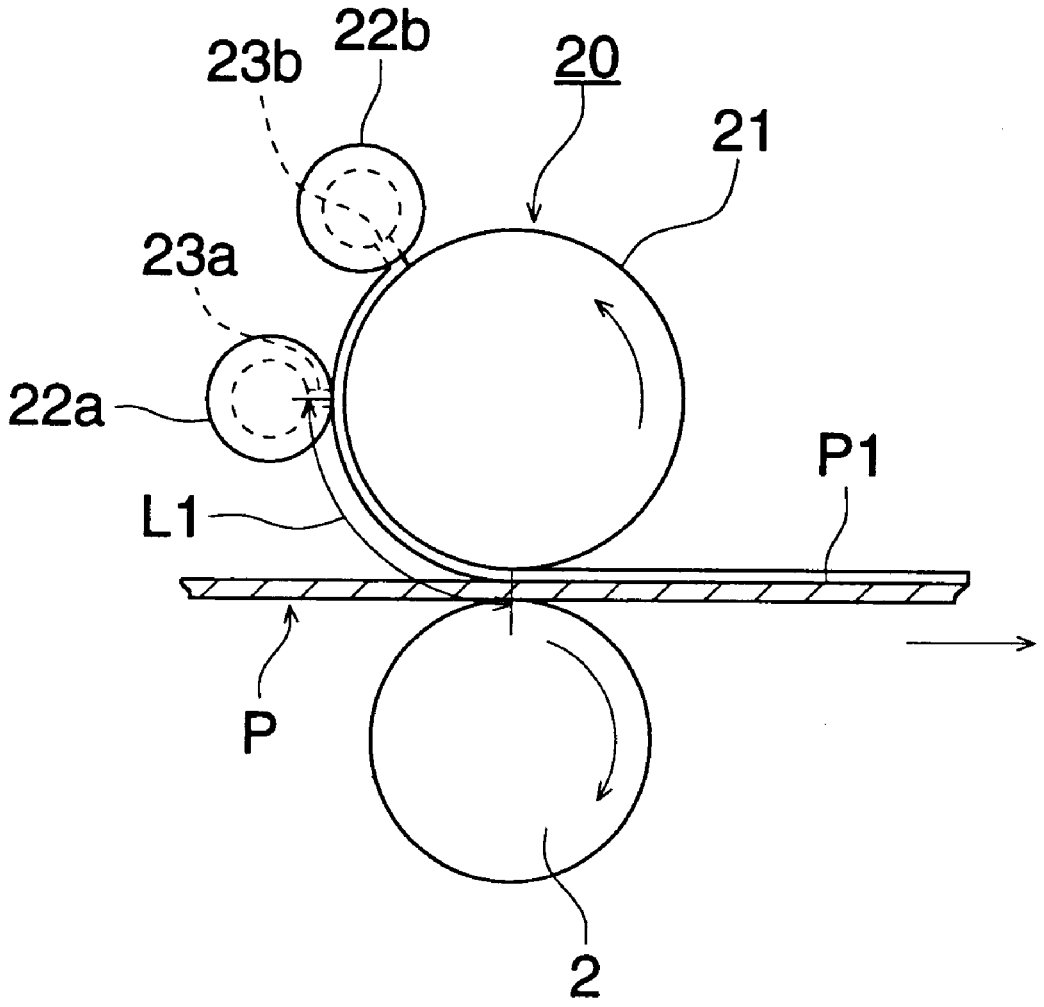
FIG. 6 is an enlarged schematic constitution view of a coating supply section.

FIG. 6 is a schematic constitution view of another embodiment of coating section of the automatic processor for silver halide light-sensitive photographic materials.

In the coating supply section 20, a coating roller 21 coats a processing composition onto the image forming surface P1 of the silver halide light-sensitive photographic material P, and a processing composition supply means 22*a* and 22*b*, which supply the processing composition to the coating roller 21 are provided, and the coating roller 21 is rotated to the conveyance direction at nearly the same speed as that of the silver halide light-sensitive photographic material P. The contact angle of a processing composition in respect to the coating roller 21 is set between 5° and 60°, and the processing composition supplied onto the coating roller 21 is uniformly formed. Thus, the processing composition can be uniformly coated onto the image forming surface P1 of the silver halide light-sensitive photographic material P to enable quality processing without causing uneven processing. When the contact angle of the processing composition in respect to the coating roller 21 is less than the set angle, the thickness of coating layer becomes excessively thin, while when the contact angle is more than the set angle, the thickness of the coating layer becomes excessively thick. By setting the contact angle of the processing composition, in respect to the coating roller, between 5° and 60°, it is possible to make a coating uniform layer and adjust the thickness appropriately.

The processing composition supply means 22*a* and 22*b* comprise a composition supply exits 23*a* and 23*b*. The distance between the composition supply exits 23*a* and 23*b*, and the coating roller 21 is between 0.2 and 10 mm, and a constant volume of the processing composition can be supplied to the coating roller without causing a turbulent flow. When the distance is less than the set distance, the processing composition on the coating roller is disordered due to the supply pressure, while when the distance is more than the set, the supply of the processing composition becomes unstable to cause flow turbulence on the coating roller.

Figure 7:
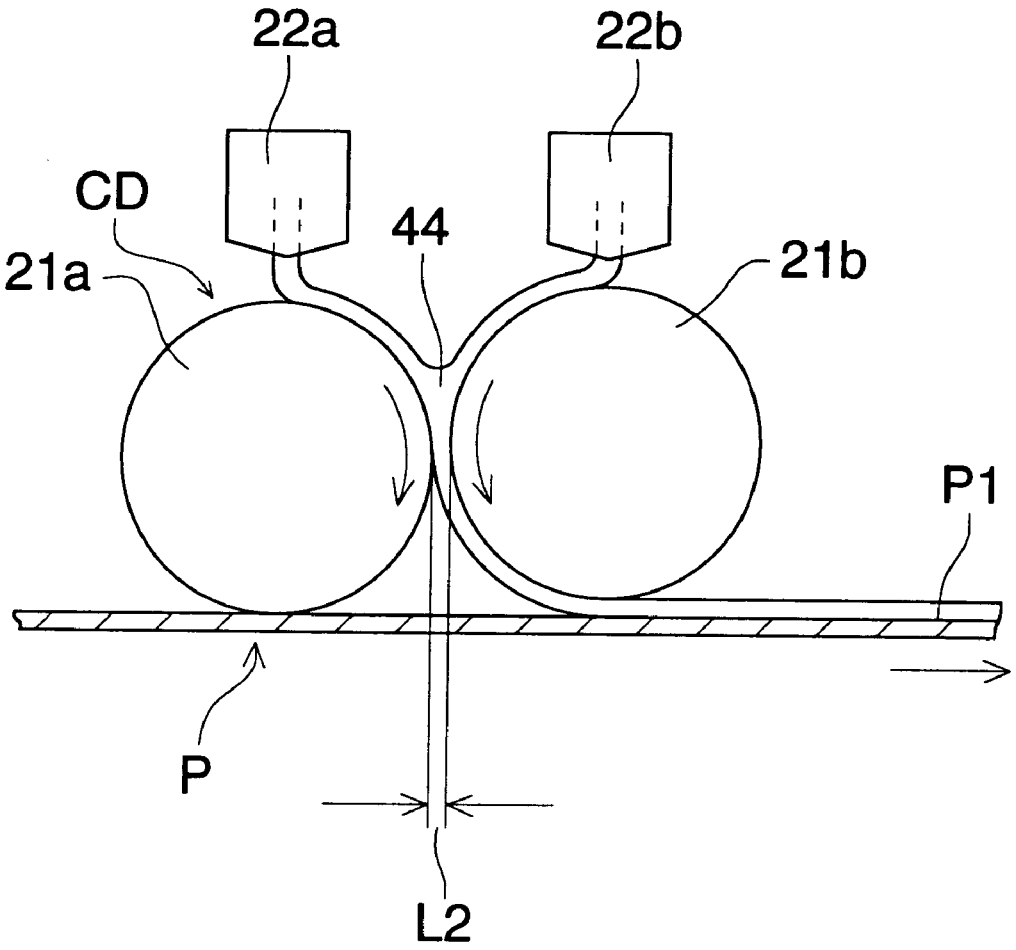
FIG. 7 is an enlarged schematic constitution view of a coating supply section.

FIG. 7 is a schematic constitution view of another embodiment of a development process of an automatic processor for silver halide light-sensitive material. The development process CD is provided; in this development process, a pair of coating rollers 21*a* and 21*b* which coat a processing composition are arranged with a supply gap L2 between them, and the coating rollers 21*a* and 21*b* each rotates in the direction of the arrow. Above the coating roller 21*a*, there is arranged one processing composition supply means 22*a* and under the coating roller 21*b*, there is arranged another processing composition supply means 22*b*.

A processing composition is composed of at least two compositions of a partial composition containing an alkali agent and a partial composition containing a color developing agent. The partial composition containing the color developing agent is supplied onto the coating roller 21*a* from the processing composition supply means 22*a* and the partial composition containing the alkali agent is supplied onto the coating roller 21*b* from the processing composition supply means 22*b*. The partial composition containing the color developing agent and the partial composition containing the alkali agent are preliminarily mixed in a staying portion 44 on the gap between the coating rollers 21*a* and 21*b*, and the resulting mixed composition is supplied onto the image forming surface P1 of the silver halide light-sensitive photographic material P from the supply gap L2 employing the rotation of the coating rollers 21*a* and 21*b* to enable a decrease in processing time.

The mixed composition in this staying portion 44 flows on the coating roller 21*b* from the supply gap L2 and is coated onto the image forming surface P1 of the silver halide light-sensitive photographic material P. The contact angle between the coating roller 21*b* and the processing composition is set at 5° to 60° and the processing compositions are homogeneously mixed on the coating roller 21*b*. Thus, it is possible to make the coating layer on the image forming surface P1 of the silver halide light-sensitive photographic material P uniform and to adjust to the appropriate thickness.

Figure 8:
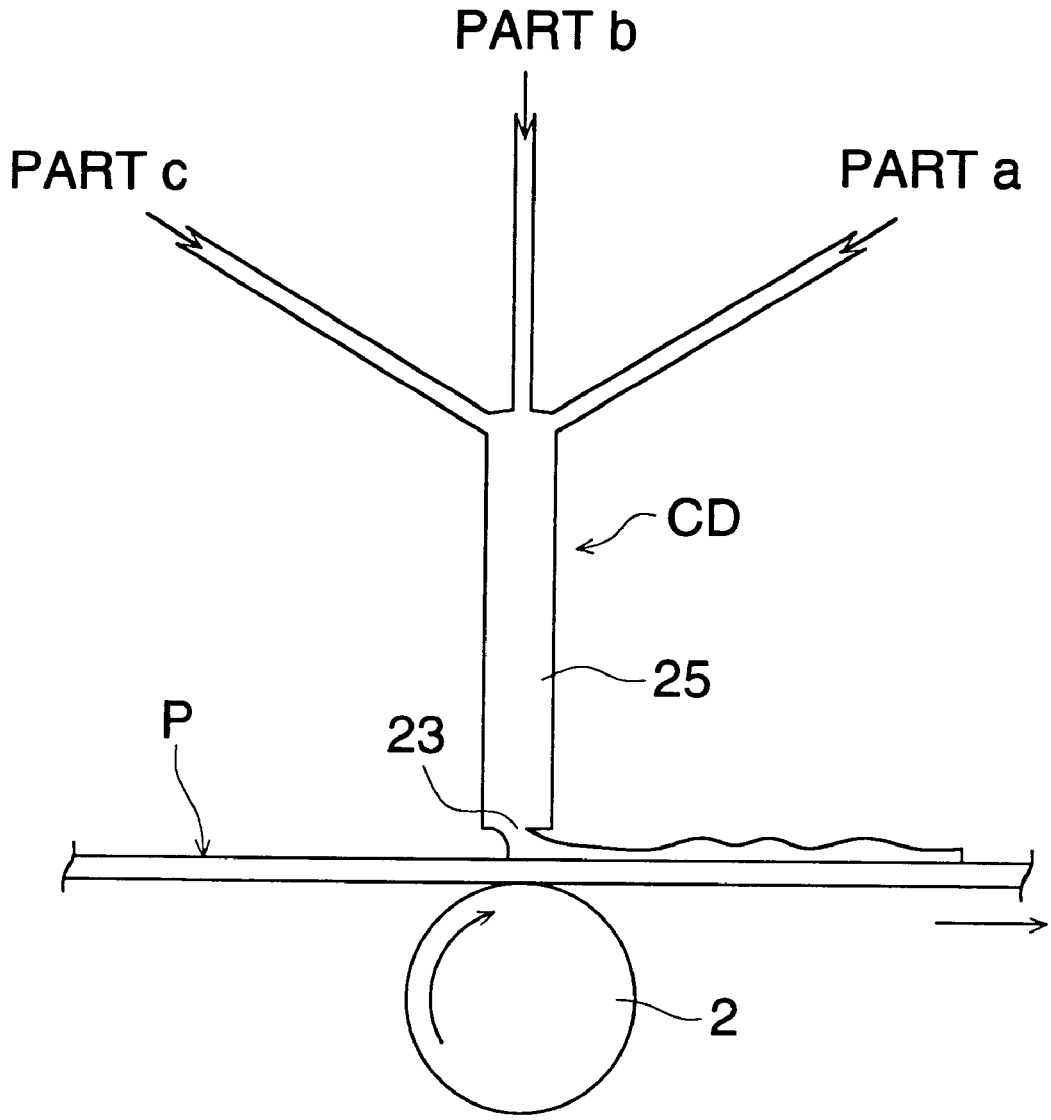
FIG. 8 is an enlarged schematic constitution view of a coating supply section.

FIG. 8 is a schematic constitution view of another embodiment of coating section of the automatic processor for silver halide light-sensitive photographic materials. Partial composition c is mixed in addition to compositions a and b at large volume mixing section 25, and the mixture is supplied to a light sensitive material P1 through outlet 23. The light sensitive material P1 is transported by transport roller 2.

Figure 9:
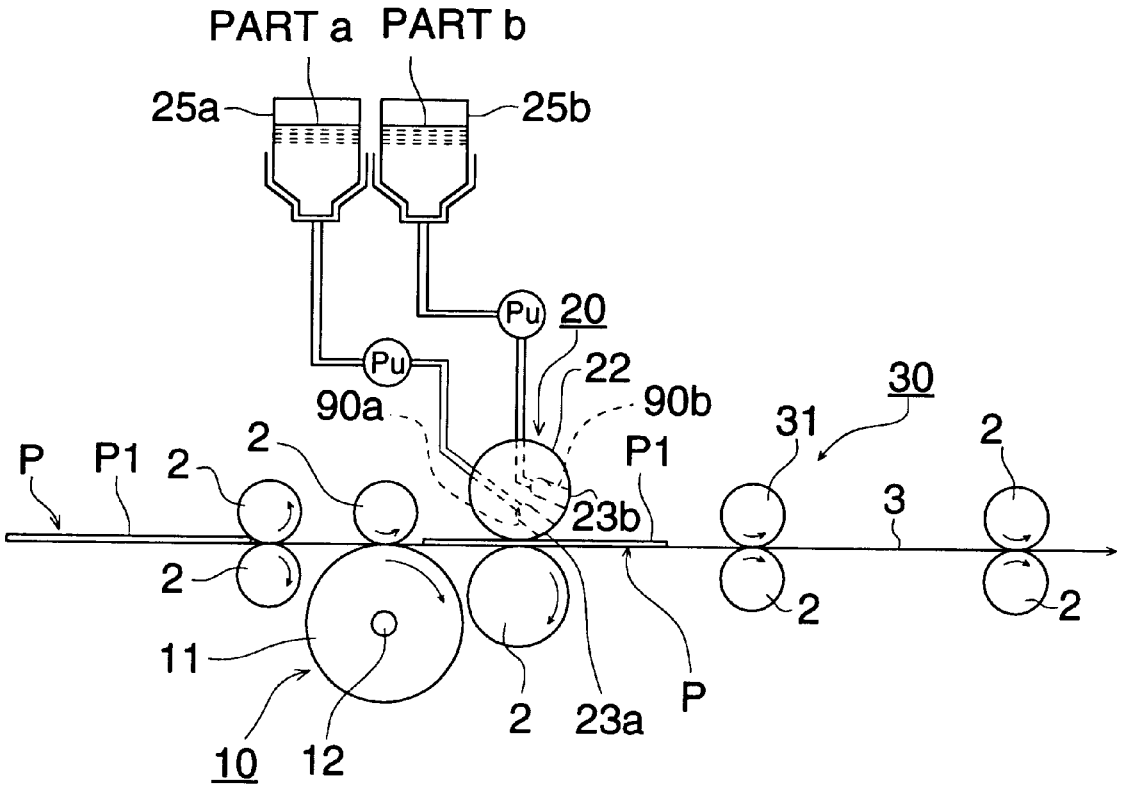
FIG. 9 is an enlarged schematic constitution view of a coating supply section.
Figure 10:
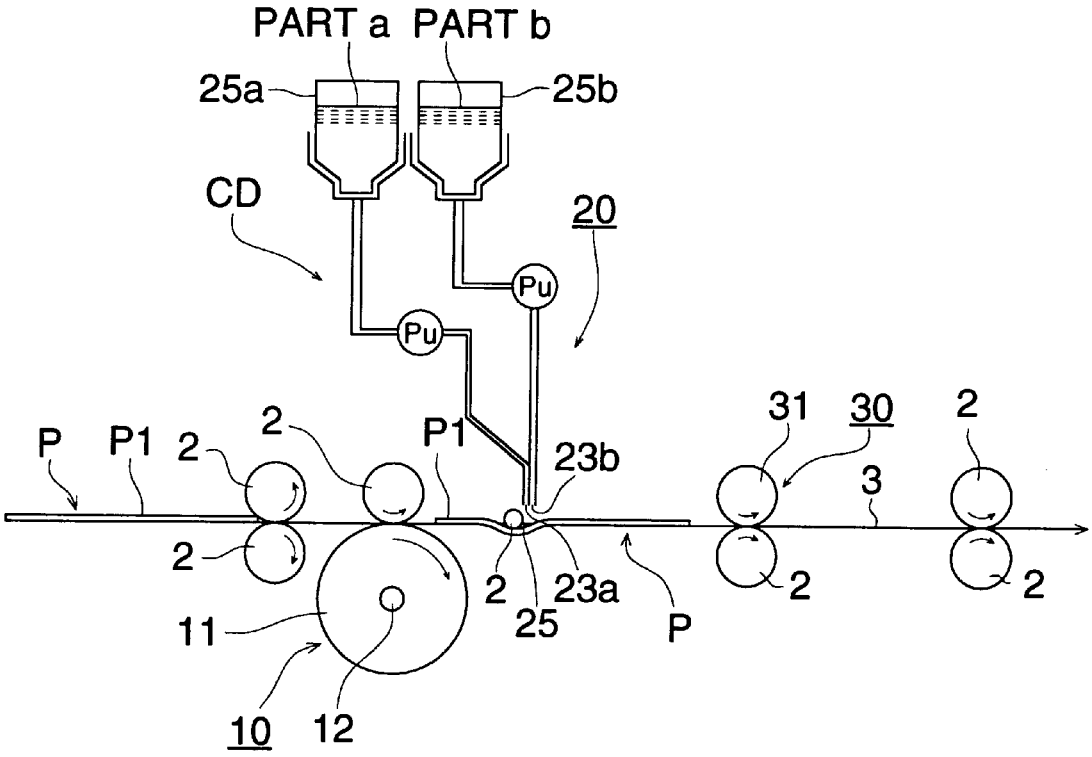
FIG. 10 is an enlarged schematic constitution view of a composition supply section.

FIGS. 9 and 10 are each an enlarged schematic constitution view of a composition supply section.

In this embodiment shown in FIG. 9, the same parts as those in FIGS. 1 and 2 have the same reference numerals and the explanation is abbreviated. A composition supply pipe 22 provided in a composition supply section 20 is fixed and the interior of the composition supply pipe 22 is divided into two chambers 90*a* and 90*b*. Compositions a and b are supplied into chambers 90*a* and 90*b*, respectively, and these chambers are filled with the compositions. Each composition is ejected from each of composition supply exits 23*a* and 23*b* and the compositions "a" and "b" are mixed while running on the wall surface of the composition supply pipe 22.

Processing compositions are composed of at least two compositions consisting of a partial composition containing a color developing agent and a partial composition containing an alkali agent. The partial composition containing the color developing agent is supplied into chamber 90*a* in coating pipe 22 from the composition supply section 20. In the same manner, the partial composition containing the alkali agent is supplied into chamber 90*b* in coating pipe 22. These partial compositions containing the color developing agent and the alkali agent are preliminarily mixed on the wall of coating pipe 22 and are supplied onto the image forming surface P1 of the silver halide light-sensitive photographic material P. Therefore, it is possible to decrease the processing time.

In the embodiment shown in FIG. 10, the same parts as those in FIGS. 1 and 2 have the same reference numerals and the explanation is abbreviated. Partial compositions a and b are supplied to mixing section 25 provided in the transporting path as concave form, where they are mixed, and the mixture is supplied to a light sensitive material P1. The transport roller 2 rotates so as to accelerate the mixing of the partial compositions.

Figure 11:
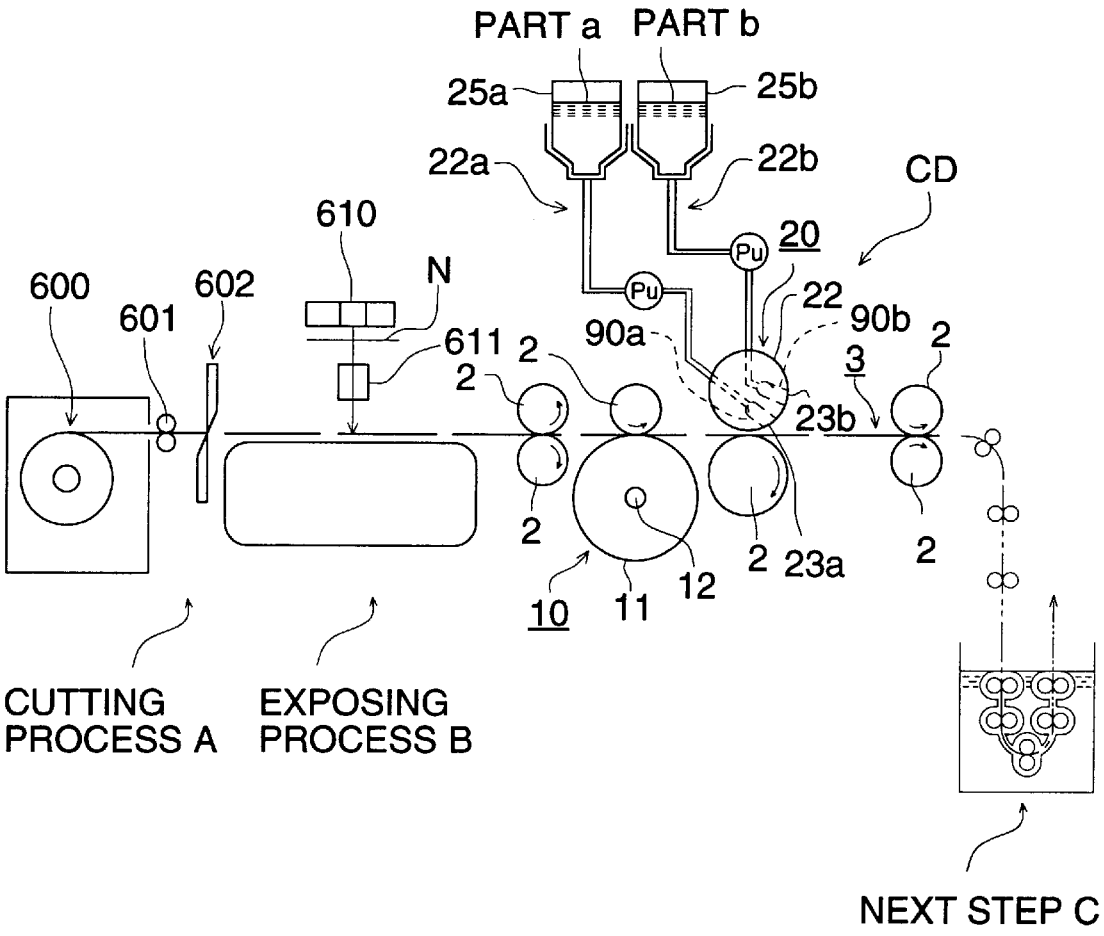
FIG. 11 is a schematic constitution view of still further another embodiment of a development process of an automatic processor for silver halide light-sensitive photographic materials.

FIG. 11 is a schematic constitution view of another embodiment of an automatic processor for silver halide light-sensitive photographic materials. In the embodiment a cutting process A is provided, which cut the silver halide light-sensitive photographic materials prior to the processing at the coating process, and rapid process is available and environmental adaptability is also improved.

Magazine 600 containing a silver halide light-sensitive photographic material in roll shape is set, and the light sensitive material is forwarded out by roll out roller 601. The silver halide light-sensitive photographic material is cut by cutting means such as cutter 602 provided at cutting section A into a sheet silver halide light-sensitive photographic material.

At the exposing section, light source 610 and lens optical system 611 is provided by which image on negative film N is exposed on the sheet silver halide light-sensitive photographic material, and the light sensitive material is transported to coating process by transporting means 612.

Figure 12:
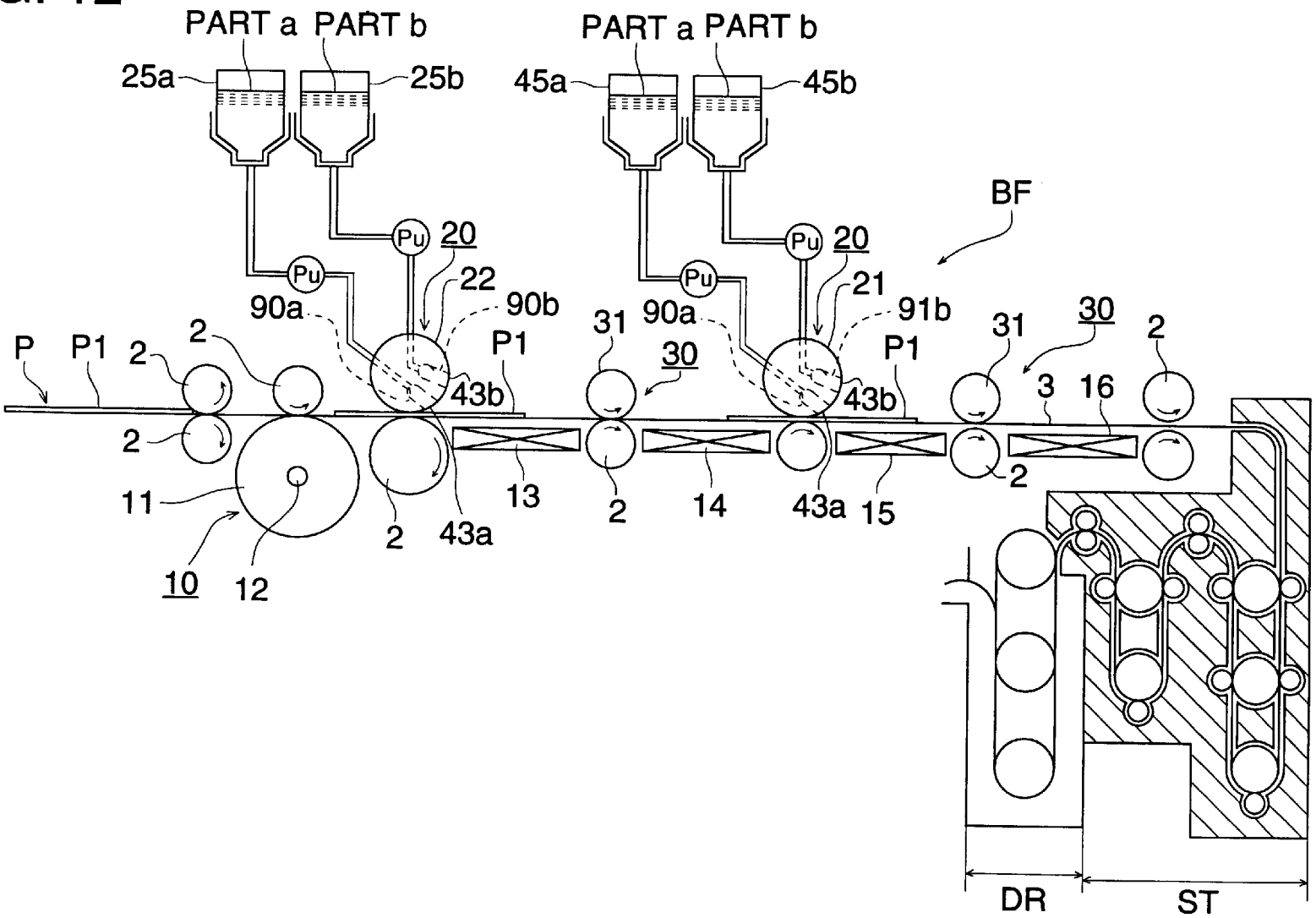
FIG. 12 is a schematic constitution view of further another embodiment of a development process of an automatic processor for silver halide light-sensitive photographic materials.

FIG. 12 is a schematic constitution view of another embodiment of an automatic processor for silver halide light-sensitive photographic materials. In this embodiment, the development process CD is constituted in the same manner as in FIGS. 1, 2, 9 and 10. A composition supplying section 40 is provided with bleach-fixing process BF. A composition supply pipe 42 provided in a composition supply section 40 is fixed and the composition supply pipe 42 is divided into two chambers 91*a* and 91*b*. Each of two chambers 91*a* and 91*b* is supplied and filled with each of the processing compositions a and b via pump Pu, a bellows pump, a tube pump, etc. from each of the processing composition tanks 45*a* and 45*b* and each composition is ejected from each composition supply exits 43*a* and 43*b* and mixed with compositions c and d, while flowing on the wall surface of a composition supply pipe 42.

The processing compositions of the bleach-fixing process BF are composed of at least two compositions consisting of a partial composition containing a bleaching agent and a partial composition containing a fixing agent and these compositions c and d are previously mixed on the wall surface of a coating pipe 42 and the resulting mixed composition is supplied onto the image forming surface P1 of a silver halide light-sensitive photographic material P. Thus the processing time can be decreased.

The development process CD in the present invention refers to the time from when a color developing partial composition is first supplied to a silver halide light-sensitive photographic material to the time when the processing composition of the subsequent bleach-fixing process BF is supplied. In the development process CD, a squeeze section 30 and heaters 13 and 14 are arranged, and in the bleach-fixing process BF, the squeeze section 30 and heaters 15 and 16 are arranged in the same manner.

EXAMPLE 2

Experiments were carried out in such a way that in Example 1, the material of the coating roller was varied as shown in Table 1 below, and the contact angle of the coating roller in respect to a partial composition containing an alkali agent is varied as shown in Table 1. The conditions and the experimental results are shown below.

(Processing Composition Formulas per liter)

<Partial Composition Containing Color Developing Agent>

| | |
|---|---|
| Water | 700 ml |
| Sodium sulfite | 0.4 g |
| Diethylenetriaminepentaacetic acid 5Na | 3.0 g |
| p-Toluenesulfonic acid | 30.0 g |
| 4-Amino-3-methyl-N-ethyl-(β-(methane-sulfonamido)ethyl)aniline sulfate salt (CD-3) | 40.0 g |
| Water to make | 1 liter |

The pH is adjusted to 2.0 employing potassium hydroxide or 50% sulfuric acid.

<Partial Composition Containing Alkali>

| | |
|---|---|
| Water | 600 ml |
| Diethylenetriaminepentaacetic acid 5Na | 3.0 g |
| Potassium carbonate | 80.0 g |
| p-Toluenesulfonic acid | 20.0 g |
| Water to make | 1 liter |

The pH is adjusted to 13.0 employing potassium hydroxide or 50% sulfuric acid.

A bleach-fixing process and a stabilizing process were conducted by using CPK-2-J1 process composition manufactured by Konica Corp.

The processing conditions are as follows.

| Process | Time | Temperature |
|---|---|---|
| Preheat | 2 seconds | 70° C. |
| Color Development Process | 10 seconds | 55° C. |
| Bleach-fixing Process | 12 seconds | 38° C. |
| Stabilizing Process | 15 seconds | 38° C. |
| Drying Process | 15 seconds | 70° C. |

As a silver halide light-sensitive color photographic material, Color Paper QA-A6 manufactured by Konica Corp. was employed with a width was 300 mm and a length of 420 mm. The above-mentioned color paper was heated employing a heat roller and as the squeeze roller, a phenol resin roller with Teflon coating was employed.

After processing 1 $m^2$ of the above-mentioned color paper, the lower roller in the composition supply section was observed and evaluated according to the following standard.

A: No problematic stain is found.

B: A little stain is found.

C: Stain is found clearly and is stacked to the paper.

The composition supply section employed was porous and zigzag. The composition supply section was shaped in a cylinder with an outer diameter of 20 mm. The holes's diameter was 0.1 mm having a pitch of 0.2 mm. The 1,440 holes were arranged in line. The composition supply was set at 60 ml per $m^2$ for each. Length L1 was set by the angle of the rotating composition supply section and by varying the gap (L2) between the paper and the lower end of the composition supply section by changing the height of the composition supply section. The rotation direction of the composition supply section was the later side of the conveyance direction.

Uneven development was evaluated according to the following standard.

A: any uneven development is not found
B: slight uneven development is found in end parts
C: uneven development is clearly found in end parts
D: uneven development is found in the whole area

TABLE 1

| Experiment No. | Material of Coating Roller | Contact Angle of Coating Roller with Processing Composition | Uneven Development | Stain at lower roller |
|---|---|---|---|---|
| 1-1 | Polyethylene | 70° | C | A |
| 1-2 | Teflon | 82° | C | A |
| 1-3 | Phenol Resin | 60° | C–B | A |
| 1-4 | Phenol Resin Laminated with 6 nylon | 40° | A | A |
| 1-5 | Polyvinyl alcohol | 55° | B | A |
| 1-6 | SUS316L | 30° | A | A |
| 1-7 | Phenol Resin Laminated with Polyurethane | 20° | A | A |
| 1-8 | Nickel | 10° | B | A–B |
| 1-9 | Glass | 5° | B–C | A–B |

As is clearly seen in the above Table 1, it reveals that adjusting the contact angle of the coating roller with the processing composition to the range of 5° to 60° exhibits excellent effects to minimize uneven development and staining the lower roller is not caused. It is also found that particularly 10° to 55° is preferable and 20° to 40° is most preferable.

EXAMPLE 3

In Experiment No. 1-5, the total processing composition supply amount was set as shown in Table 2 and the same evaluation was conducted.

TABLE 2

| Experiment No. | Processing Composition Supply Amount | Uneven Development | Stain on Lower Roller |
|---|---|---|---|
| 2-1 | 5 ml | C | A |
| 2-2 | 10 ml | C–B | A |
| 2-3 | 20 ml | B | A |
| 2-4 | 30 ml | B | A |
| 2-5 | 60 ml | B | A |
| 2-6 | 120 ml | B | A–B |
| 2-7 | 160 ml | B–C | B |
| 2-8 | 200 ml | C | B |

As clearly seen in Table 2, the advantages of the present invention can be further exhibited by setting the total processing composition supply amount to a coating roller of 10 to 160 ml per $m^2$ of a light-sensitive material.

EXAMPLE 4

In the device of FIG. 1 used in the Example 1, processing temperature was varied shown in Table 3 and experiments were carried out. The processing compositions were same as Example 2.

Composition supply pipe having slit was used. The material of the pipe is SUS36L. The composition supply portion is cylinder shaped having outer diameter of 40 mm and slit gap of 0.1 mm. The composition supply exit for color developing agent partial composition is provided at a portion of 15 mm upper from the bottom end of the pipe with regard to circumference direction. The composition supply exit for alkali agent partial composition is provided at a portion of 25 mm upper from the bottom end of the pipe with regard to circumference direction.

The same evaluation as Example 1 was performed.

TABLE 3

| Experiment No. | Temperature of light sensitive material (° C.) | Uneven Development | Stain on Lower Roller |
|---|---|---|---|
| 3-1 | 40 | C | B |
| 3-2 | 45 | B | A |
| 3-3 | 50 | B | A |
| 3-4 | 60 | A | A |
| 3-5 | 70 | A | A |
| 3-6 | 80 | A | A |
| 3-7 | 90 | B | A |
| 3-8 | 95 | B–C | A |

Based on Table 3, it is seen that by raising the temperature of a light-sensitive material, excellent uneven development minimizing effect is exhibited and no stain is formed on the lower roller.

EXAMPLE 5

In the device of FIG. 9 of Example 1, experiments were performed by, as shown in FIG. 4 mentioned below, varying a solution flow path length until mixed solutions are coated onto the image forming surface of a light-sensitive material. The composition of the processing solution was the same as Example 2. The flow path length from the point where a partial solution containing a color developing agent and a partial solution containing an alkali agent were mixed each other to the light-sensitive material was varied by moving the solution supply exit. The other conditions were the same as Examples 2 though 5. The volume of a solution staying portion was set at 20 ml.

The evaluation was carried out in the same manner as Example 1. Furthermore, stain on the table around a developing solution staying portion was observed and was evaluated in the same manner as in Example 1.

TABLE 4

| Experiment No. | Distance of flow path (mm) | Uneven Development | Stain on Table |
|---|---|---|---|
| 4-1 | 3 | B–C | A |
| 4-2 | 5 | B | A |
| 4-3 | 10 | A | A |
| 4-4 | 30 | A | A |
| 4-5 | 50 | A | A |
| 4-6 | 100 | A | A–B |
| 4-7 | 150 | B | B |
| 4-8 | 180 | B | B |

Base on Table 4, it is seen that by setting the solution flow path length between 5 and 150 mm, excellent uneven development minimizing effect is exhibited and no stain on the lower roller was formed.

EXAMPLE 6

In the present embodiment, as shown in FIG. 11, a cutting process A is provided which cut a silver halide light-sensitive photographic material P prior to being processed; and a stock roll magazine 600 is set in which the silver halide light-sensitive photographic material P wound in a roll shape is mounted, and from the magazine 600, the silver halide light-sensitive photographic material P is pull out and cut employing a cutter 601. The cut sheet of the silver halide light-sensitive photographic material P is conveyed to an exposure process B. In the exposure process B, the sheet of the silver halide light-sensitive photographic material P set on a conveyance means 612 is subjected to image exposure from a negative film N.

The exposed silver halide light-sensitive photographic material P is conveyed to a development process CD. In this development process CD, a conveyance path 3 is formed which conveys the silver halide light-sensitive photographic material P and is provided in the horizontal direction. The sheet of the silver halide light-sensitive photographic material P which has been cut into a sheet prior to being conveyed to the development process CD is conveyed in such a state that the image forming surface is placed upside; subjected to development process in the development process CD and conveyed to the subsequent process.

With the use of the device shown in this FIG. 11, 5 $m^2$ of the precut light-sensitive material with a size of 127 mm×89 mm was processed under the same conditions as Example 5. However, the flow path length was set at 10 mm. The evaluation was carried out in the same manner as in Example 1, and excellent results were obtained regarding the uneven development and table stain.

EXAMPLE 7

A partial solution containing a bleaching component and a partial solution containing a fixing component were prepared as mentioned below, and experiments were performed in the same manner as Examples 2 and 3, employing the device in FIG. 10 of Example 1.

| Partial Solution Containing | Added Amount per Liter |
|---|---|
| Bleaching Component | |
| Bleaching Agent (described in Table 1) | 0.4 mole |

The pH is adjusted to 5.0 employing aqueous ammonia. Partial Solution Containing

| Partial Solution Containing | |
|---|---|
| Fixing Component | |
| Ammonium thiosulfate | 0.8 mole |
| Ammonium sulfite | 0.02 mole |

The residual silver amount in the light-sensitive material was measured and the uneven development was evaluated employing the same standards as Example 2. Furthermore, the stain on the lower roller in the bleach-fixing process section was evaluated. Further, CyDTA in Table 5 represents the following compound.

TABLE 5

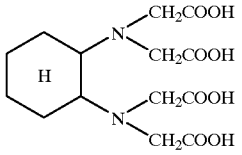

| Experiment No. | | Residual Silver Amount | Uneven Development | Stain on Lower Roller |
|---|---|---|---|---|
| 5-1 | CyDTA Fe Complex Salt | 1.2 mg/$m^2$ | C | B |
| 5-2 | Fe Complex Salt of A-5 | 0.3 mg/$m^2$ | B | A |
| 5-3 | Fe Complex Salt of A-6 | 0.2 mg/$m^2$ | B | A |
| 5-4 | Fe Complex Salt of (I-1) | 0.4 mg/$m^2$ | B | A |
| 5-5 | Fe Complex Salt of (I-3) | 0.3 mg/$m^2$ | B | A |
| 5-6 | Fe Complex Salt of (III-1) | 0.3 mg/$m^2$ | B | A |
| 5-7 | Fe Complex Salt of (A-10) | 0.3 mg/$m^2$ | B–C | B |

EXAMPLE 8

Figure 13:
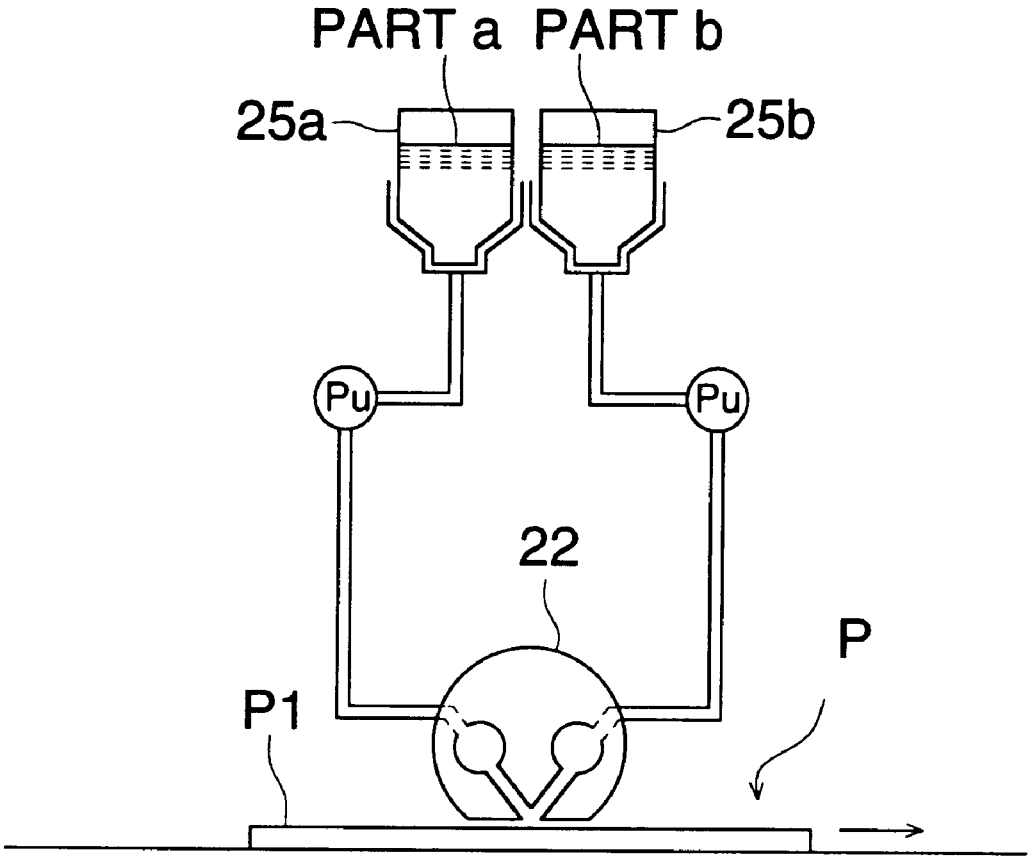
FIG. 13 is an enlarged schematic constitution view of a composition supply section.

FIG. 13 is a schematic view showing a means which supplies at least two partial solutions to a silver halide light-sensitive photographic material, and a device which mixes solutions as soon as supplied. Two slits are provided in the solution supply pipe and one end is connected with a partial solution storing means. The solution is supplied to a light-sensitive material from the solution supply exit employing an solution supply pump. The width of the slit is preferably between 0.05 and 0.5 mm. Furthermore, at 25*a* and 25*b*, a partial solution containing a developing agent and a partial solution containing an alkali agent are stored. Because a light-sensitive material P1 is conveyed at a constant speed, solutions are mixed on the image forming surface at the same time when supplied to the image forming surface.

What is claimed is:

1. An automatic processor for a silver halide light-sensitive photographic material, comprising:

a coating section configured to coat the photographic material with a processing composition without immersing the photographic material in a composition reservoir, said coating section including:

at least two reservoirs for separately storing a partial processing composition containing a developing agent and a partial composition containing an alkali agent, respectively; and a supply mechanism configured to supply each of said partial compositions from their respective reservoirs to said silver halide light-sensitive photographic material in a mixture flow path containing a mixture of said partial processing compositions, wherein said mixture flow path has a distance ranging from 5 mm to 150 mm; and a cutting section located prior to the coating section, said cutting section for cutting the photographic material to be processed prior to coating the photographic material.

2. An automatic processor for a silver halide light-sensitive photographic material of claim 1, further comprising a heating mechanism which directly heats said silver halide light-sensitive photographic material.

3. An automatic processor for a silver halide light-sensitive photographic material of claim 2, wherein the heating mechanism heats said silver halide light-sensitive photographic material to not lower than 45° C.

4. An automatic processor for a silver halide light-sensitive photographic material of claim 1, wherein the automatic processor comprises a control mechanism to control the total processing composition supply amount from an exit of said processing composition supply mechanism to a coating roller in a range from 10 ml per $m^2$ to 160 ml per $m^2$ of said light sensitive material.

5. An automatic processor for a silver halide light-sensitive photographic material of claim 1, wherein the supply mechanism to supply each of said partial compositions to said silver halide light-sensitive photographic material after mixing said partial compositions comprises a control mechanism to control a volume of the mixture at a staying position ranging from 1 to 100 ml.

6. An automatic processor for a silver halide light-sensitive photographic material of claim 1, wherein the supply mechanism to supply each of said partial compositions to said silver halide light-sensitive photographic material after mixing said partial compositions includes a stirring roller.

7. An automatic processor for a silver halide light-sensitive photographic material of claim 1, wherein the supply mechanism to supply each of said partial compositions to said silver halide light-sensitive photographic material after mixing said partial compositions comprises at least two composition supply exits which supply each of the partial processing compositions, and the partial compositions are mixed between said composition supply exits and said silver halide light-sensitive photographic material.

8. An automatic processor for a silver halide light-sensitive photographic material of claim 1, wherein the composition supply mechanism has an exit in the form of a slit.

9. An automatic processor for a silver halide light-sensitive photographic material of claim 1, further comprising a contact angle control mechanism which controls a contact angle of at least one of said processing compositions with respect to a circumference of an exit of said composition supply mechanism in the range of 5° to 6°.

10. An automatic processor for a silver halide light-sensitive photographic material of claim 1, wherein the coating section includes a bleach-fixing section and the processing composition for said bleach-fixing section includes a partial composition containing a bleaching agent and a partial composition containing a fixing agent.

11. An automatic processor for a silver halide light-sensitive photographic material of claim 10, wherein the bleaching agent comprises at least one of ferric complex salts represented by general formulas (A), (I), (II), and (III), General formula (A)

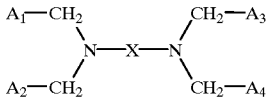

wherein $A_1$, $A_2$, $A_3$, and $A_4$ are the same or different and each represents —$CH_2OH$, —COOM or —$PO_3M_1M_2$. M, $M_1$ and $M_2$ each represents a hydrogen atom, a sodium atom, a potassium atom, or an ammonium group. X represents a substituted or unsubstituted alkylene group having from 2 to 6 carbon atoms, General formula (I)

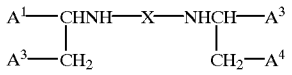

wherein $A^1$, $A^2$, $A^3$, and $A^4$ each represents —$CH_2OH$, —$PO_3(M)_2$ or —COOM, and may be the same or different. M represents a cation X represents an alkylene group having from 2 to 6 carbon atoms, or —$(B^1O)_n$—$B^2$—. N represents an integer of 1 to 8. $B^1$ and $B^2$ may be the same or different, General formula (II)

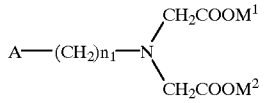

wherein herein $n_1$ represents 1 or 2, and A represents —$COOM^3$, —OH, —$NH_2$ or —$PO_3(M^3)_2$. $M^1$, $M^2$, and $M^3$ each represents a hydrogen ion, an ammonium ion, a sodium ion, a potassium ion, a lithium ion, or an organic ammonium ion, General formula (III)

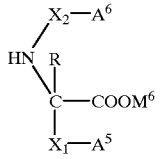

wherein herein $A^5$ and $A^6$ each represents —$COOM^7$, —$PO_3(M^7)_2$, —$SO_3M^7$, a hydroxyl group, or a mercapto group, each may be the same or different. $M^6$ and $M^7$ each represents a cation. R represents a hydrogen atom, an aliphatic or aromatic group, and $X_1$ and $X_2$ each represents a divalent aliphatic group, a divalent aromatic group, or a divalent linking group composed of a divalent aromatic group or aliphatic group and an aromatic group.

12. An automatic processor for silver halide described in claim 1, wherein the composition flow path distance ranges from 7 mm to 100 mm in length.

13. An automatic processor for a silver halide described in claim 12, wherein the composition flow path distance ranges from 10 mm to 50 mm in length.

14. A process for automatically developing a silver halide light-sensitive photographic material, comprising:

coating the photographic material with a processing composition without immersing said photographic material in a composition reservoir, said coating including:

supplying partial processing compositions from at least two reservoirs separately storing the respective partial processing compositions to said photographic material prior to coating the photographic material in a mixture flow path containing a mixture of said partial processing compositions, wherein said mixture flow path has a distance ranging from 5 mm to 150 mm; and cutting the photographic material prior to coating the photographic material.

15. A process for automatically developing a silver halide light-sensitive photographic material of claim 14, further comprising directly heating said silver halide light-sensitive photographic material.

16. A process for automatically developing a silver halide light-sensitive photographic material of claim 14, further comprising supplying said processing composition from said supply mechanism to a coating roller prior to coating said photographic material.

17. A process for automatically developing a silver halide light-sensitive photographic material of claim 16, further comprising controlling the total processing composition supply amount exiting said processing composition supply mechanism and being supplied to said coating roller in a range of from 10 ml per $m^2$ to 160 ml per $m^2$ of said light sensitive material.

* * * * *